US007925191B2

(12) United States Patent
Sato

(10) Patent No.: US 7,925,191 B2
(45) **Date of Patent: *Apr. 12, 2011**

(54) TONER CARTRIDGE FOR DEVELOPING DEVICE

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/612,122

(22) Filed: Nov. 4, 2009

(65) Prior Publication Data

US 2010/0054819 A1 Mar. 4, 2010

Related U.S. Application Data

(63) Continuation of application No. 11/523,569, filed on Sep. 20, 2006, now Pat. No. 7,634,218.

(30) Foreign Application Priority Data

Sep. 21, 2005 (JP) ..... 2005-274096
Sep. 21, 2005 (JP) ..... 2005-274097
Sep. 21, 2005 (JP) ..... 2005-274098

(51) Int. Cl.
*G03G 15/08* (2006.01)

(52) U.S. Cl. ..... 399/263; 399/262

(58) Field of Classification Search ..... 399/119, 399/120, 262, 263
See application file for complete search history.

(56) References Cited

U.S. PATENT DOCUMENTS 4,583,832 A 4/1986 Kasamura et al.
4,937,628 A 6/1990 Cipolla et al.
5,385,181 A 1/1995 Bhagwat et al.
5,608,501 A 3/1997 Makino
5,638,159 A 6/1997 Kai et al.
5,835,822 A 11/1998 Nagasaki et al.
(Continued)

FOREIGN PATENT DOCUMENTS

EP 0668546 A2 8/1995
(Continued)

OTHER PUBLICATIONS

Extended EP Search Report dtd May 18, 2007, EP Appln. 06019608.6-2209.

(Continued)

*Primary Examiner* — Sandra L Brase
(74) *Attorney, Agent, or Firm* — Banner & Witcoff, Ltd.

(57) ABSTRACT

A toner cartridge includes: a casing; a partitioning wall; and an operation member. The casing is configured to accommodate toner therein. The casing is formed with a first casing opening. The partitioning wall is configured to be rotatable relative to the casing around a predetermined rotational axis. The partitioning wall has a side surface that extends substantially parallel to the rotational axis and a pair of opposite ends that are arranged opposing each other along the rotational axis, a first partitioning-wall opening being formed through the side surface of the partitioning wall, the first partitioning-wall opening being selectively aligned with the first casing opening when the partitioning wall is rotated relative to the casing. The operation member rotates the partitioning wall relative to the casing, the operation member including a pair of lever members rotatably supported on the casing that when rotated apply a rotating operation to both of the pair of opposite ends of the partitioning wall.

8 Claims, 19 Drawing Sheets

U.S. PATENT DOCUMENTS

| | | | | |
|---|---|---|---|---|
| 5,884,136 | A | 3/1999 | Takei et al. | |
| 5,895,143 | A | 4/1999 | Kawahara et al. | |
| 6,088,556 | A | 7/2000 | Nagasaki et al. | |
| 6,591,079 | B2 | 7/2003 | Ota et al. | |
| 7,110,708 | B2 | 9/2006 | Jeon | |
| 7,194,230 | B2 * | 3/2007 | Haruyama | 399/119 X |
| 7,266,330 | B2 | 9/2007 | Murakami et al. | |
| 7,634,218 | B2 * | 12/2009 | Sato | 399/263 |
| 2001/0021327 | A1 | 9/2001 | Ota et al. | |
| 2003/0210929 | A1 | 11/2003 | Ota | |
| 2004/0131391 | A1 | 7/2004 | Nagashiro | |
| 2004/0134560 | A1 | 7/2004 | Sato et al. | |
| 2005/0008400 | A1 | 1/2005 | Tazawa et al. | |
| 2005/0135841 | A1 | 6/2005 | Murakami et al. | |

FOREIGN PATENT DOCUMENTS

| | | | |
|---|---|---|---|
| EP | 0736814 | A1 | 10/1996 |
| EP | 0793149 | A1 | 9/1997 |
| FR | 2545235 | A1 | 11/1984 |
| GB | 2268726 | A | 1/1994 |
| JP | 4-070779 | A | 3/1992 |
| JP | 5-150648 | A | 6/1993 |
| JP | 6-161244 | A | 6/1994 |
| JP | 7-225514 | A | 8/1995 |
| JP | 9-081016 | A | 3/1997 |
| JP | 9-288394 | A | 11/1997 |
| JP | 2001-255727 | A | 9/2001 |
| JP | 2002-049209 | A | 2/2002 |
| JP | 2002-091144 | A | 3/2002 |
| JP | 2002-278427 | A | 9/2002 |
| JP | 2004-061757 | A | 2/2004 |
| JP | 2004-205587 | A | 7/2004 |
| JP | 2005-070702 | A | 3/2005 |
| JP | 2005-173568 | A | 6/2005 |

OTHER PUBLICATIONS

EP Search Report dtd Jan. 24, 2007, EP Appln. 06019608.6-2209.
Extended EP Search Report dtd Dec. 10, 2010, EP Appln. 10010067.6.
JP Office Action dtd Sep. 28, 2010, JP Appln. 2005-274097, English translation.

* cited by examiner

TONER CARTRIDGE FOR DEVELOPING DEVICE

CROSS REFERENCE TO RELATED APPLICATIONS

This application is a continuation of U.S. application Ser. No. 11/523,569, filed Sep. 20, 2006, which claims priority from Japanese Patent Application Nos. 2005-274096 filed Sep. 21, 2005, 2005-274097 filed Sep. 21, 2005, and 2005-274098 filed Sep. 21, 2005. The entire content of each of these priority applications is incorporated herein by reference.

TECHNICAL FIELD

The disclosure relates to a toner cartridge for accommodating toner in a casing and for supplying the toner to a developing device when mounted in the developing device, the developing device functioning to develop electrostatic latent images into toner images by depositing toner on the electrostatic latent images.

BACKGROUND

Various types of image-forming devices have been developed for forming images on a recording medium. One such conventional image-forming device includes a developing device that deposits toner onto electrostatic latent images to develop the latent images into toner images, and a toner cartridge that is mounted in the developing device for accommodating toner in a casing and supplying the toner to the developing device. This type of image-forming device forms images by transferring the toner images developed by the developing device onto the recording medium.

One of these image-forming devices disclosed in United States Patent Application Publication No. US 2004/134560 A1 includes a toner cartridge mounted in a developing device, which toner cartridge includes a cylindrical casing having a first opening formed in the outer peripheral surface thereof for discharging the toner; and a cylindrical slide cover covering the outer peripheral surface of the casing and having a second opening formed therein for exposing the first opening when positioned opposite the same.

In order to mount the toner cartridge in the developing device, the user holds the slide cover of the toner cartridge with one hand and exposes the first opening of the toner cartridge by rotating the casing of the toner cartridge with the other hand until the first opening is positioned opposite the second opening. When removing the toner cartridge from the developing device, the user holds the slide cover of the toner cartridge with one hand and closes the first opening in the toner cartridge with the other hand by rotating the casing of the toner cartridge until the first opening no longer opposes the second opening.

SUMMARY

In recent years, there has been a growing demand for thinner image-forming devices that can be used in an office or the like without taking up a large amount of space. One step that can be taken to help produce a thinner image-forming device is to reduce the diameter of the casing provided in the toner cartridge.

However, reducing the diameter of the toner cartridge casing also reduces the capacity of the toner cartridge for accommodating toner.

In the image-forming device described above, the user can open and close the first opening in the toner cartridge simply by rotating the casing of the toner cartridge. However, since the user can only use one hand to rotate the casing of the toner cartridge, the casing is difficult to rotate, making the operation of opening and closing the first opening in the toner cartridge problematic.

Therefore, it is an object of the invention to provide a toner cartridge that can contribute to a thinner image-forming device without reducing the toner accommodating capacity of the toner cartridge, while facilitating opening and closing of an opening formed in the casing of the toner cartridge for discharging toner.

In order to attain the above and other objects, the invention provides a toner cartridge, including: a casing; a partitioning wall; and an operation member. The casing is configured to accommodate toner therein. The casing is formed with a first casing opening. The partitioning wall is configured to be rotatable relative to the casing around a predetermined rotational axis. The partitioning wall has a side surface that extends substantially parallel to the rotational axis and a pair of opposite ends that are arranged opposing each other along the rotational axis, a first partitioning-wall opening being formed through the side surface of the partitioning wall, the first partitioning-wall opening being selectively aligned with the first casing opening when the partitioning wall is rotated relative to the casing, the first partitioning-wall opening providing communication between the interior and exterior of the casing to discharge toner from the casing when aligned with the first casing opening. The operation member rotates the partitioning wall relative to the casing, the operation member including a pair of lever members rotatably supported on the casing, the pair of lever members applying a rotating operation to both of the pair of opposite ends of the partitioning wall when the pair of lever members is rotated.

According to another aspect, the invention provides a combination of a toner cartridge and a developing device. The toner cartridge includes: a casing that is configured to accommodate toner therein, the casing being formed with a first casing opening; a partitioning wall that is configured to be rotatable relative to the casing around a predetermined rotational axis, the partitioning wall having a side surface that extends substantially parallel to the rotational axis and a pair of opposite ends that are arranged opposing each other along the rotational axis, a first partitioning-wall opening being formed through the side surface of the partitioning wall, the first partitioning-wall opening being selectively aligned with the first casing opening when the partitioning wall is rotated relative to the casing, the first partitioning-wall opening providing communication between the interior and exterior of the casing to discharge toner from the casing when aligned with the first casing opening; and an operation member rotating the partitioning wall relative to the casing, the operation member including a pair of lever members rotatably supported on the casing that when rotated apply a rotating operation to both of the pair of opposite ends of the partitioning wall. The developing device develops electrostatic latent images by depositing toner discharged from the toner cartridge onto the latent images. The developing device includes: a developing-device wall that is configured to receive the toner cartridge thereon, the developing-device wall being formed with a developing-device-side opening that is disposed opposite the first casing opening in the toner cartridge to receive toner discharged from the first casing opening through the first partitioning-wall opening when the developing-device wall receives the toner cartridge thereon; a shutter that is configured to be capable of opening and closing the developing-device-side opening; a holding mechanism that holds the shutter so that the shutter is capable of moving between a position exposing the developing-device-side opening and a position closing the developing-device-side opening; and a transmission mechanism that engages with the lever members of the toner cartridge to move the shutter as the lever members rotate and that transmits the rotation of the lever members to the both ends of the partitioning wall in the toner cartridge.

According to another aspect, the invention provides a toner cartridge including: a casing; a partitioning wall; an operation member; a first motive force generating unit; and a second motive force generating unit. The casing is configured to accommodate toner therein, the casing being formed with a first casing opening, the casing having one edge and another edge opposite to the one edge along a predetermined direction, the one edge being located at an upstream side relative to the another edge in the predetermined direction, the first casing opening being located at the another edge. The partitioning wall is configured to be rotatable relative to the casing around a predetermined rotational axis, the partitioning wall having a side surface that extends substantially parallel to the rotational axis, a first partitioning-wall opening being formed through the side surface of the partitioning wall, the first partitioning-wall opening being selectively aligned with the first casing opening when the partitioning wall is rotated relative to the casing, the first partitioning-wall opening providing communication between the interior and exterior of the casing to discharge toner from the casing when aligned with the first casing opening. The operation member rotates the partitioning wall relative to the casing. The first motive force generating unit is provided inside the casing between the one edge and the another edge and generates a motive force to convey toner in the predetermined direction toward the first casing opening. The second motive force generating unit is provided inside the casing between the one edge and the another edge. The second motive force generating unit is located on the upstream side of the first motive force generating unit in the predetermined direction and generates another motive force to convey toner in the predetermined direction toward the first motive force generating unit.

According to another aspect, the invention provides a developing device for developing an electrostatic latent image into a toner image by depositing toner thereon. The developing device includes: the toner cartridge described above; a developing casing that receives the toner cartridge with the predetermined direction of the toner cartridge extending substantially horizontally so as to convey toner substantially in a horizontal direction toward the first casing opening; and a developing mechanism mounted in the developing casing device and developing an electrostatic latent image into a toner image by depositing toner discharged from the toner cartridge through the first casing opening.

According to another aspect, the invention provides an image-forming device for transferring a toner image onto a recording medium to form an image on the recording medium. The image-forming device includes: an image bearing unit bearing an electrostatic latent image; a developing device developing the electrostatic latent image into a toner image by depositing toner thereon; and the toner cartridge described above, the toner cartridge being mounted in the developing device with the predetermined direction of the toner cartridge extending substantially horizontally so as to convey toner substantially in a horizontal direction toward the first casing opening.

BRIEF DESCRIPTION OF THE DRAWINGS

In the drawings:

FIG. 6A-FIG. 6C are perspective views illustrating a method of mounting a disc member and an elongated shutter in the developer cartridge, wherein FIG. 6A shows the developer cartridge before the disc member and the elongated shutter are mounted on the developer cartridge, FIG. 6B shows the developer cartridge after the elongated shutter is mounted and before the disc member is mounted, and FIG. 6C shows the developer cartridge after the disc member and the elongated shutter are both mounted;

FIG. 7A through FIG. 7D are explanatory diagrams illustrating the operations of components in the toner cartridge and the developer cartridge, wherein FIG. 7A shows the state of the toner cartridge when the toner cartridge is separate from the developer cartridge, FIG. 7B shows the state of the developer cartridge from which the toner cartridge is separate, FIG. 7C shows the state of the toner cartridge when a user pushes down on the front ends of lever members after mounting the toner cartridge on the developer cartridge, and FIG. 7D shows the state of the developer cartridge when the user pushes down on the front ends of the lever members after mounting the toner cartridge on the developer cartridge;

FIG. 9A and FIG. 9B are right side views of a toner cartridge according to a first variation of the first embodiment, wherein FIG. 9A is a right side view of the toner cartridge prior to mounting the toner cartridge on the developer cartridge, and FIG. 9B is a right side view of the toner cartridge after mounting the toner cartridge;

FIG. 12A and FIG. 12B are right side views of the toner cartridge according to a modification of the first variation, wherein FIG. 12A shows the state of a lever member prior to mounting the toner cartridge on the developer cartridge and FIG. 12B shows the state of the lever member after mounting the toner cartridge;

FIG. 13A and FIG. 13B are right side views of a toner cartridge according to a second variation of the first embodiment, wherein FIG. 13A shows the state of the toner cartridge prior to being mounted on a developer cartridge and FIG. 13B shows the state of the toner cartridge after being mounted;

FIG. 15A and FIG. 15B are cross-sectional views showing the internal structure of the toner cartridge and the developer cartridge according to the second variation, wherein FIG. 15A shows the state when tip ends of lever members are pointed upward to close openings in the toner cartridge and the developer cartridge, and FIG. 15B shows the state when the lever members are rotated to cause the tip ends of the lever members to face horizontally to the rear of the casing of the toner cartridge to thereby open the openings in the toner cartridge and the developer cartridge;

FIG. 21A through FIG. 21D are explanatory diagrams illustrating the operations of components in the toner cartridge and the developer cartridge, wherein FIG. 21A shows the state of the toner cartridge when the toner cartridge is separate from the developer cartridge, FIG. 21B shows the state of the developer cartridge from which the toner cartridge is separate, FIG. 21C shows the state of the toner cartridge when a user pushes down on the front ends of lever members after mounting the toner cartridge on the developer cartridge, and FIG. 21D shows the state of the developer cartridge when the user pushes down on the front ends of the lever members after mounting the toner cartridge on the developer cartridge.

DETAILED DESCRIPTION

Figure 1:
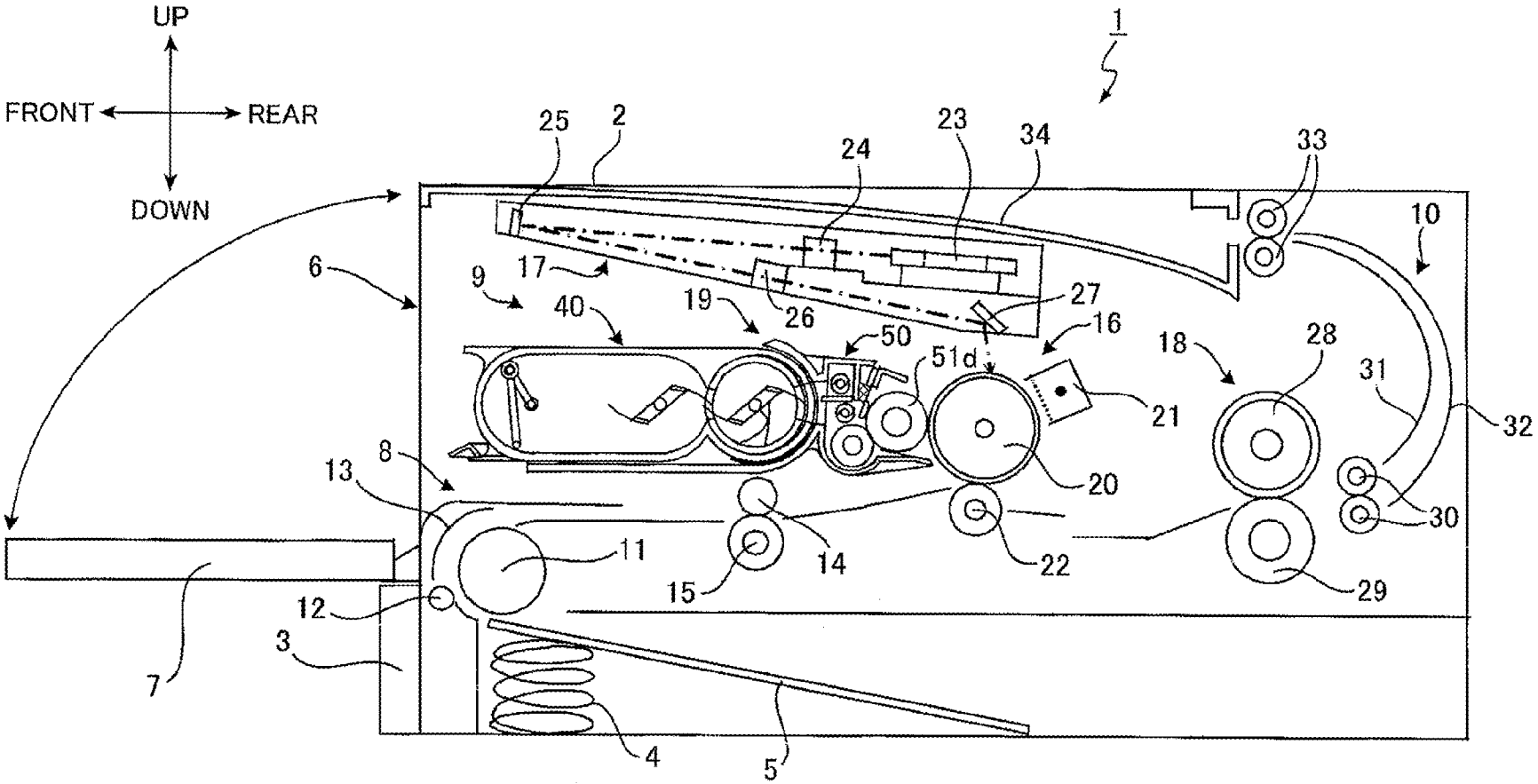
FIG. 1 is a cross-sectional view showing an internal structure of a printer according to a first embodiment of the invention.

An image-forming device according to some aspects of the invention will be described while referring to the accompanying drawings wherein like parts and components are designated by the same reference numerals to avoid duplicating description.

First Embodiment

FIG. 1 is a cross-sectional view showing a simplified internal structure of a printer 1 according to a first embodiment of the invention.

The terms "upward", "downward", "upper", "lower", "above", "below", "beneath", "right", "left", "front", "rear" and the like of the printer 1 will be used throughout the description assuming that the printer 1 is disposed in an orientation in which it is intended to be used. In use, the printer 1 is disposed as shown in FIG. 1.

As shown in FIG. 1, the printer 1 includes a main casing 2, and a paper cassette 3 that is mounted below the main casing 2. Disposed inside the paper cassette 3 are a supporting plate 5, and a spring 4 for urging the front end of the supporting plate 5 upward. Paper (not shown) is stacked on the top surface of the supporting plate 5.

The main casing 2 includes an access opening 6 formed in the front side thereof, and a cover 7 provided on the outer side of the access opening 6. The cover 7 is configured to open and close over the access opening 6.

The main casing 2 accommodates a paper-feeding mechanism 8, an image-forming mechanism 9, and a paper-discharging mechanism 10. The paper-feeding mechanism 8 includes a feeding roller 11 and a conveying roller 12 disposed in confrontation with each other at a position above and forward of the supporting plate 5. The feeding roller 11 and conveying roller 12 work in cooperation to extract paper from the front end of the supporting plate 5 one sheet at a time.

The paper-feeding mechanism 8 includes a guide 13 that forms a path leading from the front side of the feeding roller 11 to the top side of the feeding roller 11. The guide 13 functions to receive sheets of paper extracted by the feeding roller 11 and conveying roller 12 and to guide the sheets back toward the rear side of the main casing 2.

The paper-feeding mechanism 8 also includes registration rollers 14 and 15 disposed in contact with each other at a position rearward of the feeding roller 11. The registration rollers 14 and 15 work in cooperation to receive paper reversed by the guide 13 and to convey the paper to the image-forming mechanism 9.

The image-forming mechanism 9 includes a process mechanism 16, a scanning mechanism 17, and a fixing mechanism 18.

The process mechanism 16 includes a developing device 19 disposed above the paper-feeding mechanism 8. The developing device 19 includes a toner cartridge 40 and a developer cartridge 50. The toner cartridge 40 mounts on the developer cartridge 50 in a horizontal direction from the front side of the developer cartridge 50. The toner cartridge 40 and developer cartridge 50 will be described in greater detail below.

The terms "upward", "downward", "upper", "lower", "above", "below", "beneath", "right", "left", "front", "rear" and the like of the toner cartridge 40 and the developer cartridge 50 will be used throughout the description assuming that the toner cartridge 40 and the developer cartridge 50 are mounted in the printer 1 in its correct orientation. In use, the toner cartridge 40 and the developer cartridge 50 are mounted in the printer 1 as shown in FIG. 1.

The process mechanism 16 also includes a photosensitive drum 20 disposed to the rear of the developer cartridge 50 so as to contact a developing roller 51*d* provided in the developer cartridge 50. With this construction, toner carried on the developing roller 51*d* is deposited on an electrostatic latent image formed on the photosensitive drum 20 so as to develop the latent image into a toner image.

The process mechanism 16 also includes a Scorotron charger 21 disposed above and rearward of the photosensitive drum 20. The charger 21 is configured to charge the surface of the photosensitive drum 20.

The process mechanism 16 also includes a transfer roller 22 disposed below and in contact with the photosensitive drum 20. The photosensitive drum 20 and transfer roller 22 work in cooperation to receive sheets of paper from the paper-feeding mechanism 8 and to transfer the toner image formed on the photosensitive drum 20 onto the sheet of paper.

The scanning mechanism 17 is disposed above the process mechanism 16. The scanning mechanism 17 includes a laser light source (not shown) for generating a laser beam (indicated by a one-dot-and-one-chain line in FIG. 1), and a polygon mirror 23 that is driven to rotate at an equiangular velocity. The polygon mirror 23 reflects the laser beam produced by the laser light source and scans the laser beam at an equiangular velocity.

The scanning mechanism 17 also includes an fθ lens 24 disposed diagonally above and forward of the polygon mirror 23. The laser beam reflected by the polygon mirror 23 passes through the fθ lens 24, at which time the fθ lens 24 converts the scanning velocity of the laser beam from an equiangular velocity to a constant speed.

The scanning mechanism 17 also includes a reflecting mirror 25 disposed diagonally above and forward of the fθ lens 24. After the laser beam passes through the fθ lens 24, the reflecting mirror 25 reflects the laser beam diagonally downward and rearward.

The scanning mechanism 17 also includes a cylindrical lens 26 disposed diagonally downward and rearward of the reflecting mirror 25. The laser beam reflected by the reflecting mirror 25 passes through the cylindrical lens 26, at which time the cylindrical lens 26 deflects the laser beam in a sub-scanning direction when the laser beam reflects off the polygon mirror 23 at a direction different from the normal direction.

The scanning mechanism 17 also includes a reflecting mirror 27 disposed diagonally downward and rearward of the cylindrical lens 26. After the laser beam passes through the cylindrical lens 26, the reflecting mirror 27 reflects the laser beam onto the photosensitive drum 20 in order to form an electrostatic latent image on the surface of the photosensitive drum 20.

The fixing mechanism 18 includes a heating roller 28 and a pressure roller 29 disposed in contact with each other at a position rearward of the process mechanism 16. The heating roller 28 and pressure roller 29 work in cooperation to receive paper from the process mechanism 16 and to fix the toner image transferred onto the paper with heat.

The paper-discharging mechanism 10 includes a pair of conveying rollers 30 disposed in contact with each other at a position rearward of the fixing mechanism 18. The conveying rollers 30 work in cooperation to receive paper from the fixing mechanism 18 and to convey the paper toward the top of the main casing 2.

The paper-discharging mechanism 10 also includes guides 31 and 32 for forming a path that leads from the rear side of the conveying rollers 30 to the top of the main casing 2. The guides 31 and 32 function to guide the paper conveyed by the conveying rollers 30 toward the top of the main casing 2.

The paper-discharging mechanism 10 also includes a pair of discharge rollers 33 disposed in contact with each other near the upper end of the guides 31 and 32. The discharge rollers 33 work in cooperation to receive paper guided by the guides 31 and 32 and to discharge the paper onto a discharge tray 34 formed on the top outer surface of the main casing 2.

Therefore, the printer 1 is configured as a laser printer for forming images on paper. The printer 1 first forms an electrostatic latent image on the photosensitive drum 20 using a laser beam, subsequently deposits toner on the latent image to develop the image into a toner image, and finally transfers the toner image onto the paper.

Next, the toner cartridge 40 and the developer cartridge 50 will be described in greater detail.

Figure 2A:
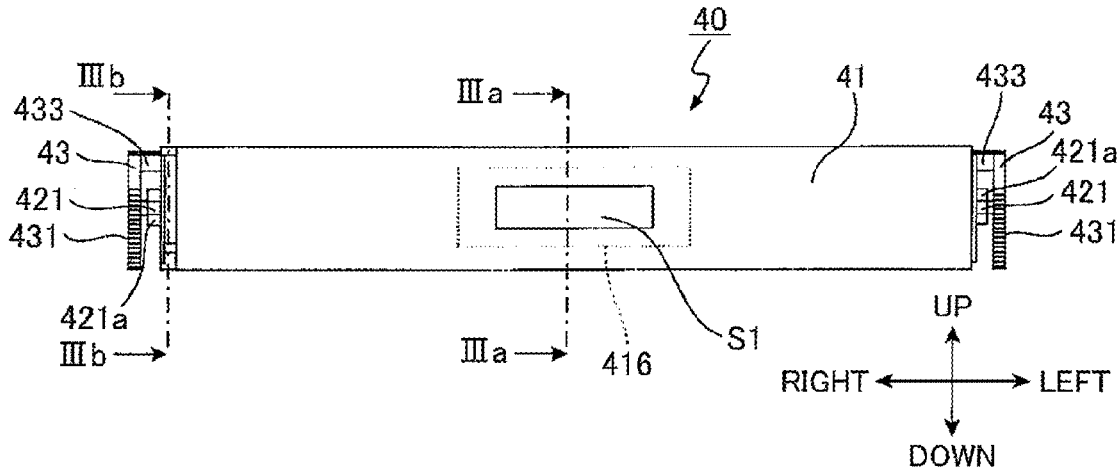
FIG. 2A is a rear view showing a toner cartridge used in the printer of FIG. 1.
Figure 2B:
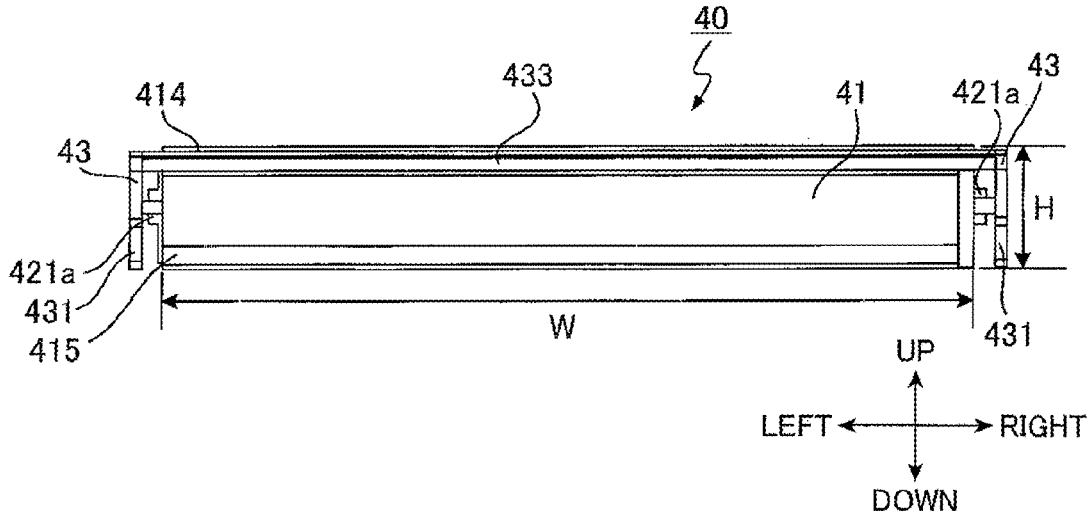
FIG. 2B is a front view of the toner cartridge.
Figure 2C:
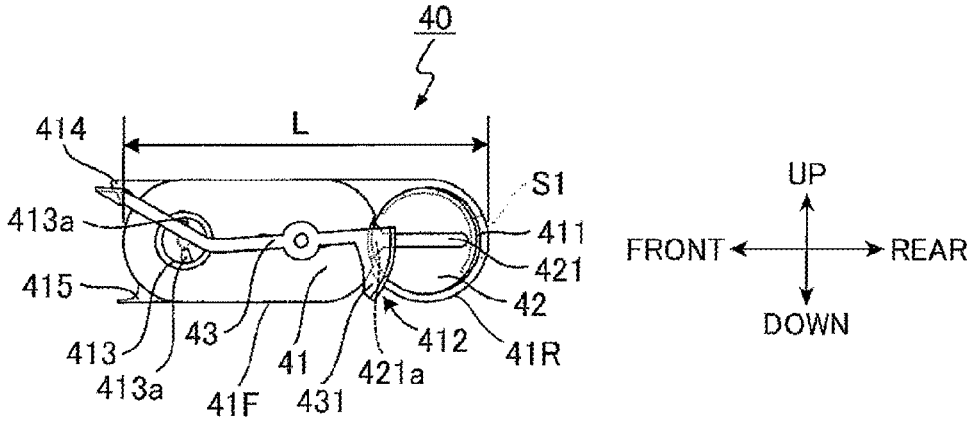
FIG. 2C is a right side view of the toner cartridge.

FIG. 2A-FIG. 2C show the outer appearance of the toner cartridge 40, wherein FIG. 2A is a rear view of the toner cartridge 40, FIG. 2B a front view of the toner cartridge 40, and FIG. 2C a right side view of the toner cartridge 40.

As shown in FIG. 2A-FIG. 2C, the toner cartridge 40 includes a casing 41 for accommodating toner. The casing 41 is in a flat shape so that a length L (see FIG. 2C) in a horizontal direction running from the front surface to the rear surface and a width W (see FIG. 2B) running in a horizontal direction from the left side surface to the right side surface are set greater than a height H (see FIG. 2B) running vertically from the bottom surface to the top surface. More specifically, the casing 41 is in a wide shape in which the width W is about twice as large as the length L.

As shown in FIG. 2C, the casing 41 has a flat top surface. The casing 41 has a bottom surface formed with a depression 412. The casing 41 has a front part 41F and a rear part 41R, with the depression 412 being located between the front part 41F and the rear part 41R.

The front part 41F is rounded or curved at its front side projecting outwardly horizontally to the front. The rear part 41R is rounded or curved at its rear side projecting outwardly horizontally to the rear and also at its bottom side projecting vertically downwardly. In other words, a portion of the rear part 41R that ranges from the rear to the bottom of the rear part 41R is substantially of a semicylindrical shape. The depression 412 is formed on the bottom surface of the casing 41 continuously with the curved bottom surface of the rear part 41R.

The casing 41 has a cylindrical through-hole 411 in its rear part 41R. The cylindrical through-hole 411 is formed through the casing 41 in the width direction. Thus, the central axis of the cylindrical through-hole 411 extends in the widthwise direction of the casing 41. The cylindrical through-hole 411 is opened at its pair of opposite sides (left and right sides). The rounded outer surface of the wall of the rear part 41R is curved following the inner peripheral surface of the wall of the rear part 41R surrounding the cylindrical through-hole 411.

As shown in FIG. 2A and FIG. 2C, the casing 41 has an opening S1 in its rear part 41R. The opening S1 is located in a widthwise and vertical center region of the curved rear wall of the casing 41, facing horizontally rearwardly. The opening S1 is formed through the rear wall of the casing 41. The opening S1 is in communication with the cylindrical through-hole 411, and allows communication between the interior and exterior of the casing 41. The opening S1 is formed in an elongated planar shape that is elongated in the width direction of the casing 41.

An inner cylinder 42 of a cylindrical shape is inserted in the cylindrical through-hole 411 of the casing 41, with the central axis of the inner cylinder 42 being in alignment with the central axis of the cylindrical through-hole 411. The inner cylinder 42 has a peripheral wall and circular side walls (circular end walls) at its pair of opposite sides (right and left sides). The peripheral wall of the inner cylinder 42 extends substantially parallel to the central axis of the inner cylinder 42, while the circular side walls of the inner cylinder 42 are arranged opposing each other along the central axis of the inner cylinder 42. The inner cylinder 42 is rotatable around its central axis relative to the rear part 41R of the casing 41, with its outer peripheral surface sliding against the inner peripheral surface of the wall of the casing 41 surrounding the cylindrical through-hole 441.

A protrusion 421 having an elongated shape is formed on each circular side wall of the inner cylinder 42. A wide part 421*a* is formed on one end of each protrusion 421 and expands in width toward the outer peripheral edge of the inner cylinder 42 on the side surface thereof.

A pair of lever members 43 is pivotably supported in the front part 41F on both side surfaces thereof. The pair of lever members 43 is pivotably supported at the approximate lengthwise center of the casing 41. Each lever member 43 extends horizontally with its rear end positioned near the inner cylinder 42 and its front end positioned near the front surface of the casing 41. Each lever member 43 is bent upward from a region midway between the pivotably supported part of the lever member 43 and the front end.

As shown in FIG. 2B, a connecting member 433 is integrally formed on the front ends of the lever members 43 for connecting the lever members 43 with each other. In other words, the pair of lever members 43 is connected together near the front surface of the casing 41.

An engaging part 431 having an arched plane-shape is formed on the rear end of each lever member 43 near the inner cylinder 42. A plurality of teeth is formed in the outer edge of the engaging part 431 facing toward the rear.

As shown in FIG. 2C, a coupling part 413 is provided on the right side surface of the casing 41 in the front part 41F for coupling with a drive shaft (not shown) on the main casing 2 side. The coupling part 413 is cylindrical in shape and has a pair of protrusions 413*a* provided on the inner peripheral edge of the coupling part 413 at opposing positions for engaging with the drive shaft on the main casing 2 side.

In the front part 41F, the casing 41 has restricting members 414 and 415 on upper and lower front edges thereof. The restricting members 414 and 415 protrude horizontally from the front edge of the casing 41 to contact the connecting member 433 of the lever members 43 and restrict the rotational range of the lever members 43.

Figure 3A:
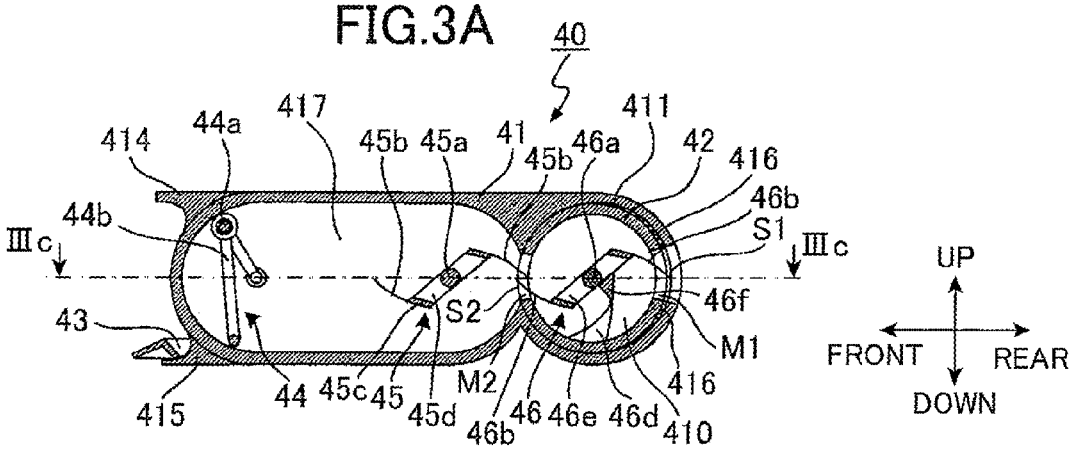
FIG. 3A is a cross-sectional view of the toner cartridge taken along a line IIIa-IIIa in FIG. 2A, showing the internal structure of the toner cartridge.
Figure 3B:
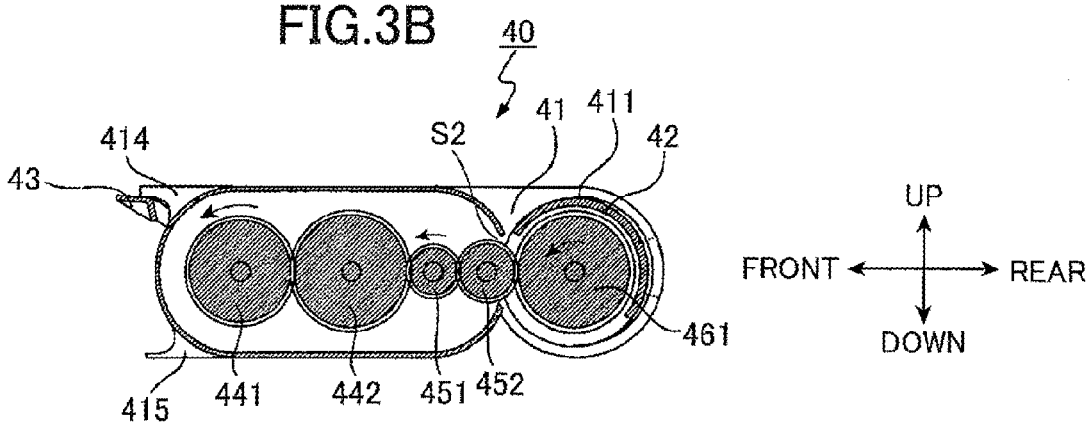
FIG. 3B is a cross-sectional view of the toner cartridge taken along a line IIIb-IIIb in FIG. 2A, showing the internal structure of the toner cartridge.
Figure 3C:
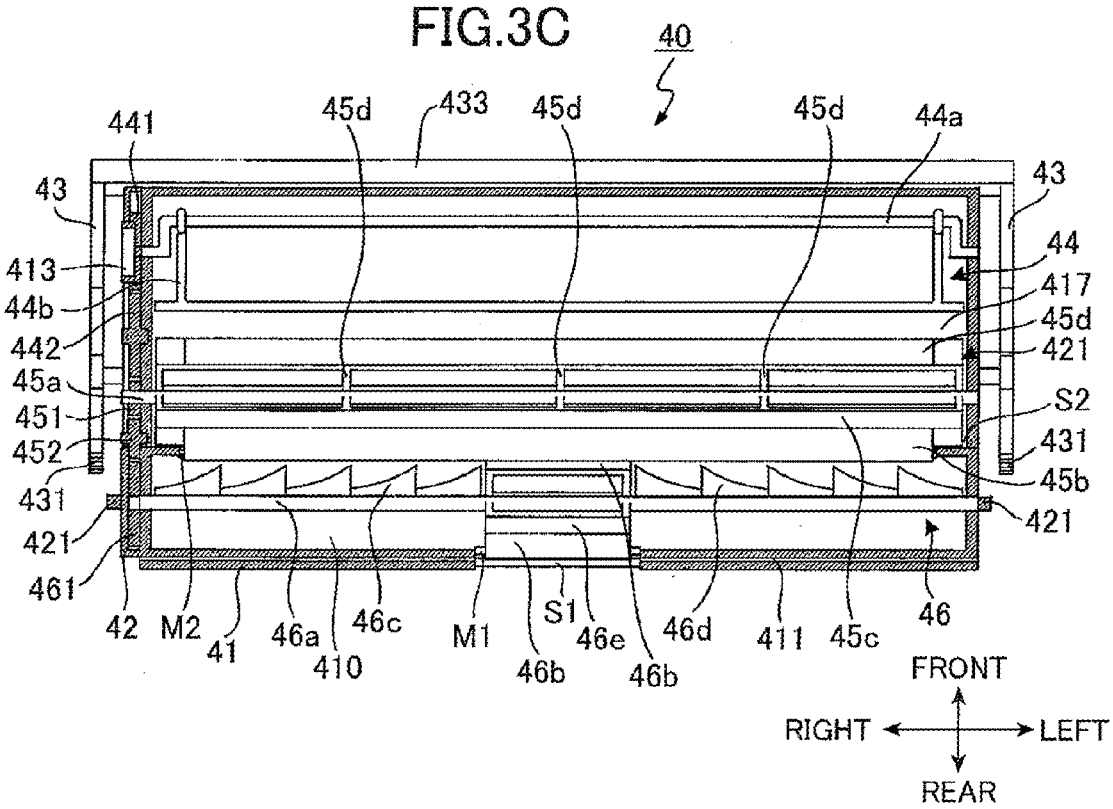
FIG. 3C is a plan view of the toner cartridge with a partial cross-section taken along a plane IIIc-IIIc shown in FIG. 3A, showing the internal structure of the toner cartridge.

FIG. 3A and FIG. 3B are cross-sectional views showing the internal structure of the toner cartridge 40. FIG. 3A is a cross-sectional view taken longitudinally through the widthwise center of the toner cartridge 40 and viewed from the right side, as indicated by the arrows IIIa in FIG. 2A. FIG. 3B is a cross-sectional view taken longitudinally through the toner cartridge 40 at the right edge of the casing 41 and is viewed from the right side, as indicated by arrows IIIb in FIG. 2A. FIG. 3C is a plan view of the toner cartridge 40 with a partial cross-section (only of the casing 41) taken along a plane IIIc-IIIc shown in FIG. 3A through the center of the casing 41 with respect to the height thereof. Of these drawings, FIG. 3B shows the interior of the casing 41 in a state in which the front ends of the lever members 43 contact the restricting member 414 and the inner cylinder 42 is in such an angular position that the wide parts 421*a* on the protrusions 421 are pointed horizontally forwardly (to be described later with reference to FIG. 7A). FIG. 3A and FIG. 3C show the interior of the casing 41 in a state in which the front ends of the lever members 43 are lowered until the lever members 43 contact the restricting member 415 to rotate the inner cylinder 42 to another angular position in which the wide parts 421*a* on the protrusions 421 are pointed vertically upwardly (to be described later with reference to FIG. 7C).

As shown in FIG. 3A and FIG. 3C, an accommodating section 417 is formed as a space inside the front part 41F of the casing 41. The accommodating section 417 is for accommodating toner therein. An opening S2 is formed between the accommodating section 417 and the through-hole 411. The accommodating section 417 is formed extending horizontally from the front surface of the casing 41 to the opening S2. The accommodating section 417 is in communication with the through-hole 411 via the opening S2. The opening S2 is located opposing the opening S1 horizontally. The opening S1, the central axis of the cylindrical through-hole 411, and the opening S2 are arranged in line in the horizontal direction. The opening S2 has the same elongated planar shape as the opening S1 but is longer in the width direction of the casing 41.

As shown in FIG. 3A, a sponge 416 is fixed to the inner peripheral surface of the rear wall of the casing 41 encircling the outer edges of the opening S1 as shown in FIG. 2A.

The outer peripheral surface of the inner cylinder 42 contacts the inner peripheral surface of the wall of the casing 41 surrounding the through-hole 441 and follows the inner peripheral surface of the wall of the casing 41 when the inner cylinder 42 rotates.

The inner cylinder 42 has an inner cylindrical hole 410 therein. An opening M1 is formed in the peripheral wall of the inner cylinder 42 and provides communication between the interior of the inner cylindrical hole 410 and the exterior of the casing 41, when positioned opposite the opening S1, thereby allowing discharge of toner outside the casing 41. The opening M1 has substantially the same planar shape and substantially the same open area as the opening S1. The opening M1 is located opposing the opening S1 when the wide parts 421*a* of the protrusions 421 on the inner cylinder 42 are pointed vertically upwardly as shown in FIG. 7C.

An opening M2 is formed in the peripheral wall of the inner cylinder 42 in communication with the inner cylindrical hole 410 at a region opposing the opening M1. In other words, the opening M1, the central axis of the inner cylinder 42, and the opening M2 are arranged in line with one another. The opening M2 has a greater open area than the opening M1. That is, the opening M2 has the same elongated planar shape as the opening M1 but is longer in the width direction of the casing 41 than the opening M1 as shown in FIG. 3C. The opening M2 is positioned opposite the opening S2 when the wide parts 421*a* of the protrusions 421 on the inner cylinder 42 are pointed vertically upwardly as shown in FIG. 7C.

The casing 41 accommodates a crank mechanism 44 and an agitator 45 in the accommodating section 417 in order from the front surface side toward the rear surface side. The inner cylinder 42 accommodates another agitator 46 in the inner cylindrical hole 410. Thus, the crank mechanism 44, the agitator 45, and the agitator 46 are arranged in this order from the front surface side to the rear surface side in the horizontal direction.

The crank mechanism 44 is configured of a crankshaft 44*a*, and a suspended member 44*b*. More specifically, the crankshaft 44*a* spans from the left end to the right end of the casing 41, with both ends bent to form an L-shape. The left end of the crankshaft 44*a* is inserted through the left side wall of the casing 41, while the right end is disposed in the right side edge of the casing 41 and couples with the center portion of a gear 441 that rotates together with the coupling part 413.

The suspended member 44*b* is configured from: a pair of rods spanning from both ends of the crankshaft 44*a* toward the bottom surface of the accommodating section 417; and a single rod coupled with the pair of rods and spanning from the left side to the right side of the casing 41 along the bottom surface of the accommodating section 417.

With this construction of the crank mechanism 44, the suspended member 44*b* reciprocates along the horizontal as the crankshaft 44*a* rotates. The rotating motion of the crankshaft 44*a* and the reciprocating motion of the suspended member 44*b* generate a motive force that agitates toner on the bottom surface of the casing 41 and conveys the toner toward the agitator 45.

The agitator 45 is configured of a rotational shaft 45*a*, and a pair of film members 45*b*. More specifically, the rotational shaft 45*a* extends from the left side to the right side of the casing 41, with the left end penetrating the left side wall of the casing 41, while the right end is coupled with the center portion of a gear 451 provided in the right side of the casing 41. The gear 451 is engaged with a gear 442, which in turn is engaged with the gear 441. The gear 442 has substantially the same diameter as the gear 441, while the gear 451 has a smaller diameter than the gear 442.

The rotational shaft 45*a* is formed with a frame 45*c* that spans from the left end of the rotational shaft 45*a* to the right end so as to surround the rotational shaft 45*a*. Dividers 45*d* are provided on the frame 45*c* at regular intervals along the axial direction of the rotational shaft 45*a*. As apparent from FIG. 3A, the frame 45*c* is in a parallelogram shape seen from either the left or right side of the casing 41.

Each of the film members 45*b* is formed of a resin sheet having a width identical to the pair of long sides constituting the frame 45*c*. The film members 45*b* are fixed to the long sides of the frame 45*c* so as to protrude in opposing directions. As shown in FIG. 3C, notches are formed in both left and right edges of the film members 45*b* on the protruding ends thereof, so that the protruding ends of the film members 45*b* can protrude into the opening M2.

With the agitator 45 having this construction, the frame 45*c* rotates together with the pair of film members 45*b* as the rotational shaft 45*a* rotates. The frame 45*c* and the film members 45*b* agitate the toner inside the accommodating section 417 and generate a motive force for conveying the toner toward the inner cylinder 42.

The agitator 46 includes a rotational shaft 46*a*, a pair of film members 46*b*, and a right-side serrated film member 46*c* and a left-side serrated film member 46*d*. More specifically, the rotational shaft 46*a* extends from the left side to the right side of the inner cylinder 42, with the left end inserted through the left side wall of the inner cylinder 42, and the right end coupled with the center part of a gear 461 disposed inside the right side wall of the inner cylinder 42. The gear 461 is engaged with a gear 452, which in turn is engaged with the gear 451. The gear 452 has a diameter substantially the same as the gear 451, and the gear 461 has a diameter substantially the same as the gear 441 and gear 442.

As shown in FIG. 3A and FIG. 3C, the rotational shaft 46*a* is formed with a frame 46*e*. As shown in FIG. 3C, the frame 46*e* is formed in the widthwise center region of the rotational shaft 46*a* and surrounds the widthwise center region of the rotational shaft 46*a*. The frame 46*e* has a width substantially the same as the width of the opening M1. As shown in FIG. 3A, the frame 46*e* has a parallelogram shape seen from the left or right side of the casing 41.

Each film member 46*b* is formed of a rectangular resin sheet having the same width as the two long sides of the frame 46*e* (that is, substantially the same width as the width of the opening M1). The film members 46*b* are fixed to the long sides of the frame 46*e* so as to protrude in opposing directions from the long sides of the frame 46*e*.

Figure 4A:
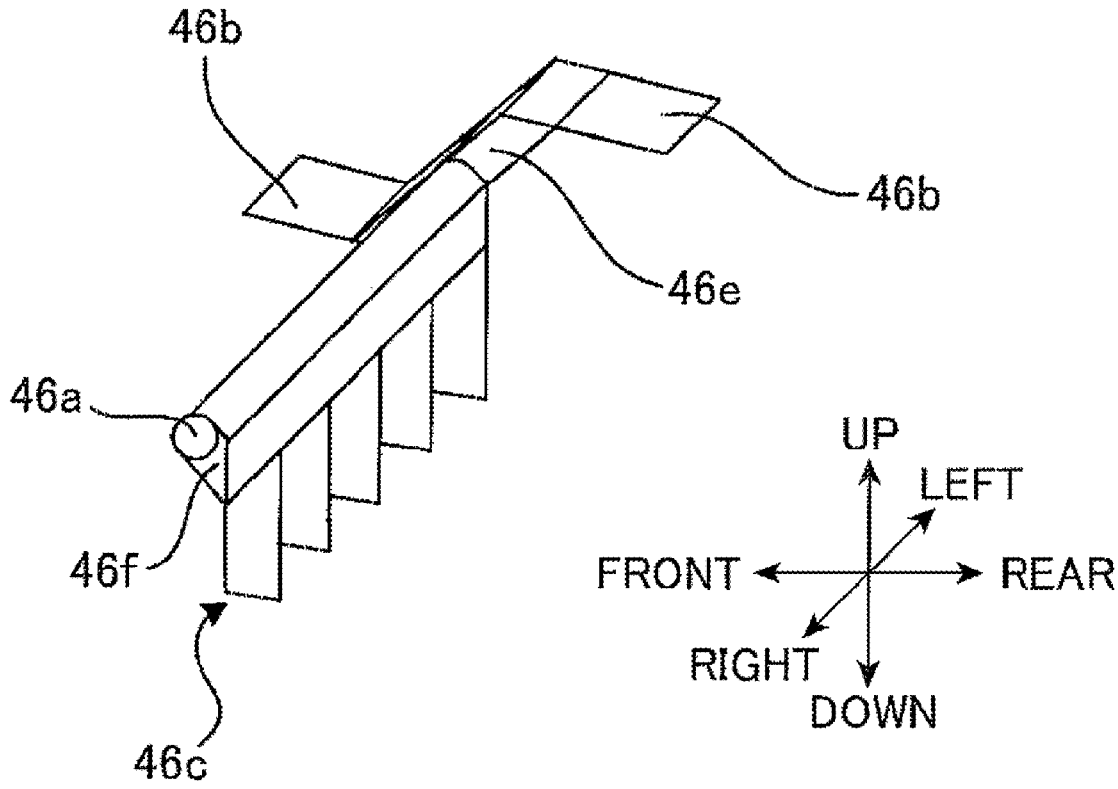
FIG. 4A is a perspective view showing a right half part of an agitator.
Figure 4B:
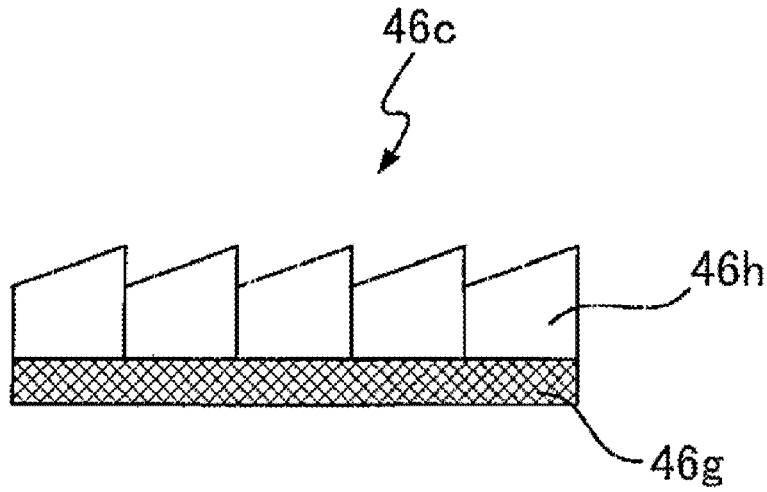
FIG. 4B is a plan view illustrating a serrated film member attached to the agitator.

Next, the right-side serrated film member 46*c* will be described with reference to FIG. 4A and FIG. 4B. FIG. 4A and FIG. 4B are explanatory diagrams showing the right-side serrated film member 46*c*. FIG. 4A is a perspective view illustrating the region of the agitator 46 from the right edge to the center portion of the rotational shaft 46*a* along its widthwise direction, while FIG. 4B is a plan view of the right-side serrated film member 46*c*.

As shown in FIG. 3A, a pair of protrusions 46*f* formed in the shape of triangular prisms protrudes outward from the rotational shaft 46*a* with one protrusion 46*f* extending from the right edge to the frame 46*e* as shown in FIG. 4A and the other extending from the left edge to the frame 46*e*. Both of the protrusions 46*f* protrude in the same direction.

As shown in FIG. 4B, the right-side serrated film member 46*c* is configured of a resin sheet, and has a fixing part 46*g* formed in an elongated shape and a plurality of teeth 46*h* formed in a series along one long side of the fixing part 46*g*. Each of the teeth 46*h* has a sloped end so that one side is longer than the other.

As shown in FIG. 4A, the teeth 46*h* are arranged in the right-side serrated film member 46*c* so that the long sides face the widthwise center portion of the rotational shaft 46*a* and the short sides face the right edge of the rotational shaft 46*a*. The fixing part 46*g* is fixed to the protrusion 46*f* that extends from the right edge of the rotational shaft 46*a* to the frame 46*e*.

The left-side serrated film member 46*d* is simply a mirror image of the right-side serrated film member 46*c*, and is fixed to the protrusion 46*f* that extends from the left edge of the rotational shaft 46*a* to the frame 46*e*. In the left-side serrated film member 46*d*, the long sides of the teeth 46*h* face the widthwise center region of the rotational shaft 46*a*, while the short sides face the left edge of the rotational shaft 46*a* (see FIG. 3C).

With the agitator 46 having this construction, as the rotational shaft 46*a* rotates, the right-side serrated film member 46*c* and left-side serrated film member 46*d* agitate toner near both right and left edges within the inner cylinder 42 to generate a motive force for scraping the toner toward the widthwise center region of the inner cylinder 42. Further, the frame 46*e* and film members 46*b* of the rotational shaft 46*a* agitate toner in the center region of the inner cylinder 42 and generate a motive force for conveying this toner toward the opening S1.

In the toner cartridge 40 having this construction, the drive shaft on the main casing 2 side causes the gear 441 to rotate counterclockwise in FIG. 3B. Accordingly, the crankshaft 44*a* of the crank mechanism 44, the rotational shaft 45*a* of the agitator 45, and the rotational shaft 46*a* of the agitator 46 all rotate in the counterclockwise direction, causing toner within the casing 41 to circulate counterclockwise therein.

Figure 5A:
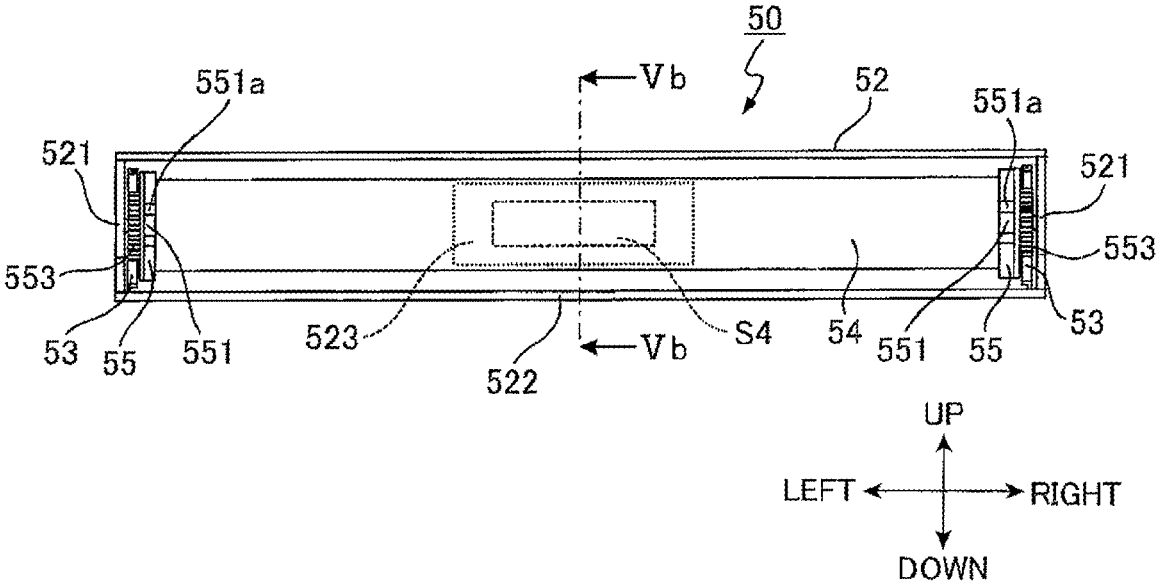
FIG. 5A is a front view of a developer cartridge.
Figure 5B:
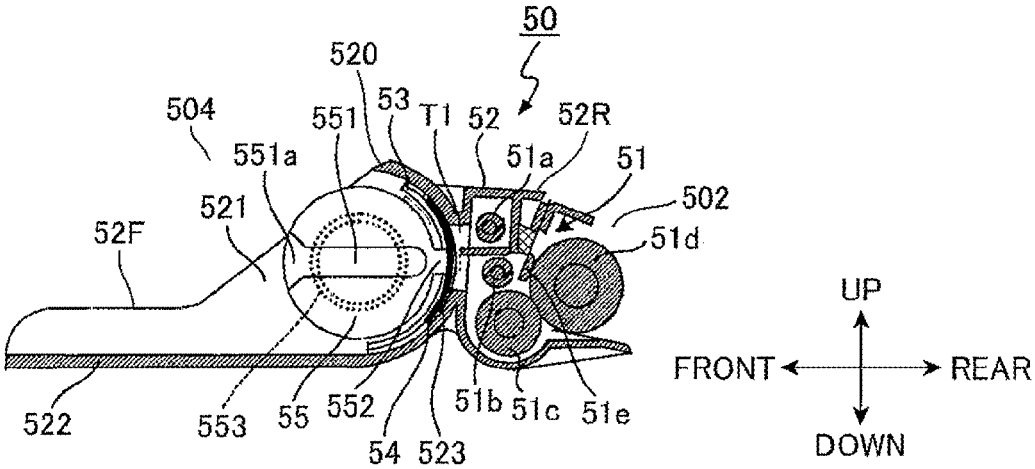
FIG. 5B is a cross-sectional view of the developer cartridge taken along a line Vb-Vb in FIG. 5A.

FIG. 5A and FIG. 5B show the structure of the developer cartridge 50. FIG. 5A is a front view of the developer cartridge 50, while FIG. 5B is a cross-sectional view taken through the left-to-right center of the developer cartridge 50 and viewed from the right side, as indicated by arrows Vb in FIG. 5A.

As shown in FIG. 5A and FIG. 5B, the developer cartridge 50 includes a casing 52. The casing 52 has a front part 52F and a rear part 52R.

A developing section 502 is defined as a space inside the rear part 52R of the casing 52. A developing mechanism 51 is accommodated in the developing section 502.

A toner-cartridge accommodating section 504 is defined as a space inside the front part 52F of the casing 52. The upper-and-front side of the front part 52F in the casing 52 is opened to allow the toner cartridge 40 to be mounted in the toner-cartridge accommodating section 504.

The developing mechanism 51 includes an upper auger 51*a*, a lower auger 51*b*, a supply roller 51*c*, the developing roller 51*d*, and a developing blade 51*e*.

More specifically, the upper auger 51*a* is a shaft-like member extending from the left side to the right side of the casing 52 within an upper section in the rear part 52R of the casing 52. Helical blades are wound around the upper auger 51*a* within the section from the left side to the right side for agitating toner and conveying toner from both ends of the casing 52 toward the center region.

The lower auger 51*b* is also configured of a shaft-like member that extends from the left side to the right side of the casing 52 within a vertical central region in the rear part 52R of the casing 52. The lower auger 51*b* also has helically wound blades extending from the left to the right side. However, these blades are configured to convey toner from the center region of the casing 52 toward both ends thereof while agitating the toner.

The supply roller 51*c* also extends from the left side to the right side of the casing 52 at a position below the lower auger 51*b*.

The developing roller 51*d* extends from the left side to the right side of the casing 52 at a position rearward of the supply roller 51*c* and is in contact with the supply roller 51*c*.

The developing blade 51*e* also extends from the left side to the right side of the casing 52 at a position between the lower auger 51*b* and the developing roller 51*d* and is in contact with the developing roller 51*d*.

The rear side of the rear part 52R in the casing 52 is open so that the developing roller 51*d* is exposed therefrom.

The front part 52F of the casing 52 is shaped to accommodate the toner cartridge 40. More specifically, the front part 52F includes: a half-round wall 520 which is curved or rounded in a semicylindrical shape so that the curved or rounded front wall of the toner cartridge 40 can be fitted thereto; a pair of side walls 521 that is formed on the left and right sides of the half-round wall 520; and a plate-shaped bottom wall 522 that protrudes horizontally from the lower front edge of the half-round wall 520.

An opening T1 is formed in the half-round wall 520 in the vertical and width center region thereof for providing communication between the front part 52F and the rear part 52R of the casing 52. The opening T1 has the same planar shape and open area as the opening S1 formed in the toner cartridge 40. A sponge 523 is fixed to the front surface of the half-round wall 520 so as to surround the outer edges of the opening T1.

A pair of arc-shaped guide members 53 is disposed on the front surface of the half-round wall 520, one on the left side and one on the right, and follows the curvature of the half-round wall 520. An elongated shutter 54 is disposed between the guide members 53 and is capable of moving over the front surface of the half-round wall 520 for covering the opening T1.

Disc members 55 are rotatably supported on the side walls 521 for engaging the toner cartridge 40. More specifically, elongated engaging grooves 551 are formed in the surfaces of the disc members 55 that are opposing each other. The engaging grooves 551 are in a shape for engaging with the protrusions 421 provided on the inner cylinder 42 of the toner cartridge 40. A wide part 551*a* is formed at one end of each engaging groove 551 for engaging with the wide part 421*a* of the corresponding protrusion 421.

A protrusion 552 protrudes from the outer edge of each disc member 55 on the side opposite the wide part 551*a*. A gear 553 is provided on the surface of each disc member 55 facing the side wall 521 on which the disc member 55 is mounted. The gears 553 engage with the engaging parts 431 provided on the lever members 43 of the toner cartridge 40 when the toner cartridge 40 is mounted on the developer cartridge 50. The gears 553 have a smaller diameter than that of the disc members 55.

Figure 6A:
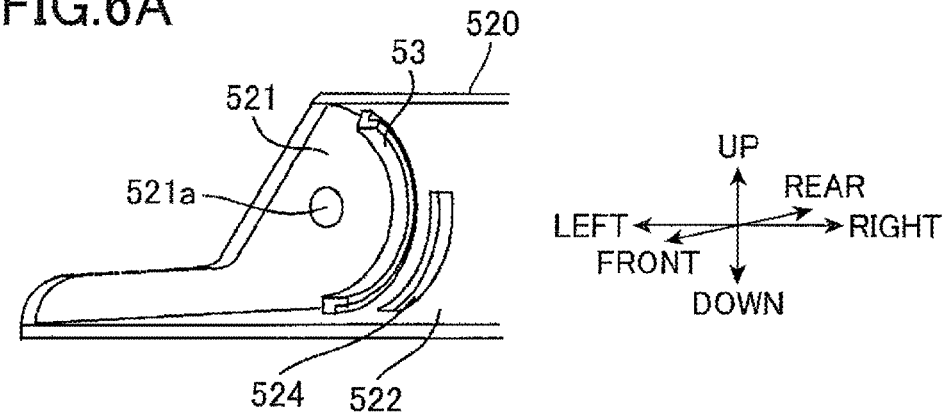
Figure 6B:
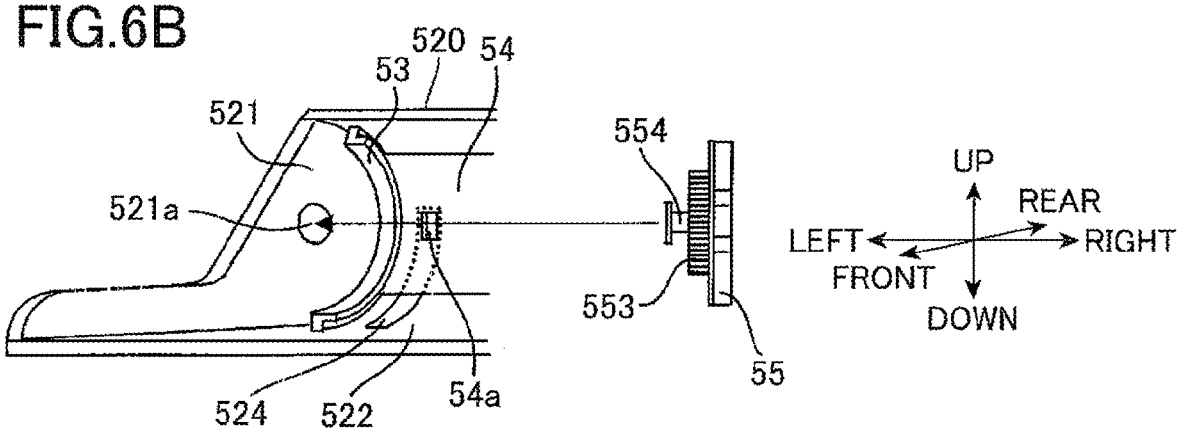
Figure 6C:
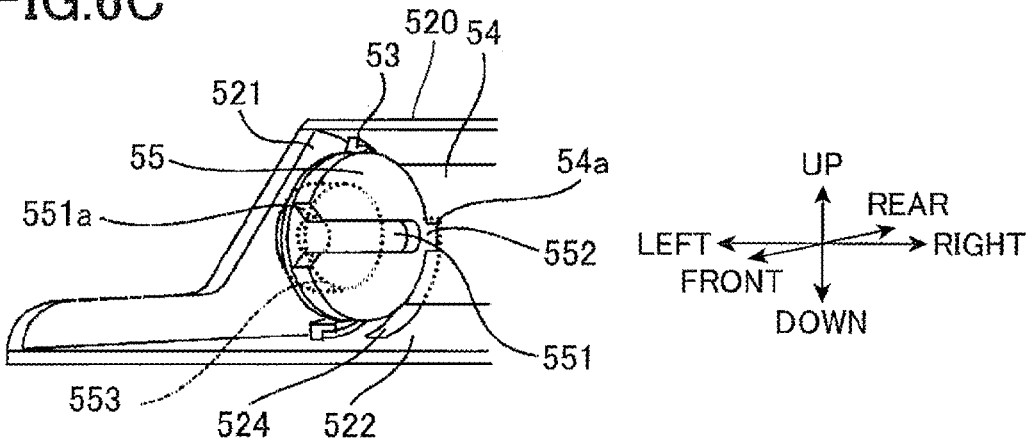

FIG. 6A-FIG. 6C are perspective views illustrating how to mount the disc member 55 and the shutter 54 on the casing 52. While FIG. 6A-FIG. 6C illustrate the method of mounting the disc member 55 on the left side of the casing 52, the process for mounting the disc member 55 on the right side is identical.

As shown in FIG. 6A, a through-hole 521*a* having a circular shape is formed in each side wall 521. Further, a guide groove 524 is formed on the front surface of the half-round wall 520 near each of the guide members 53 and follows the curvature of the guide members 53 from a vertical center region on the front surface of the half-round wall 520 to the bottom wall 522.

As shown in FIG. 6B, through-holes 54*a* are formed in the left and right edges of the shutter 54. The through-holes 54*a* have a square shape and are in communication with the guide grooves 524 when the shutter 54 is interposed between the guide members 53. The through-holes 54*a* are formed in the center region of the shutter 54 with respect to the short dimension thereof.

A rotational shaft 554 is formed on the back surface of the disc member 55. When mounting the disc member 55 on the side wall 521, as shown in FIG. 6C, the protrusion 552 of the disc member 55 is inserted into the guide groove 524 via the through-hole 54*a*, and the rotational shaft 554 is fitted into the through-hole 521*a*.

With this construction, when the disc member 55 is rotated so that the protrusion 552 faces the half-round wall 520, the shutter 54 is moved in association along the front surface of the half-round wall 520 to cover the opening T1. Similarly, when the disc member 55 is rotated so that the protrusion 552 faces the bottom wall 522, the shutter 54 is moved to a position above the bottom wall 522, thereby opening the opening T1.

FIG. 7A through FIG. 7D are explanatory diagrams illustrating how the components in the toner cartridge 40 and the developer cartridge 50 operate when a user mounts the toner cartridge 40 on the developer cartridge 50.

Figure 7A:
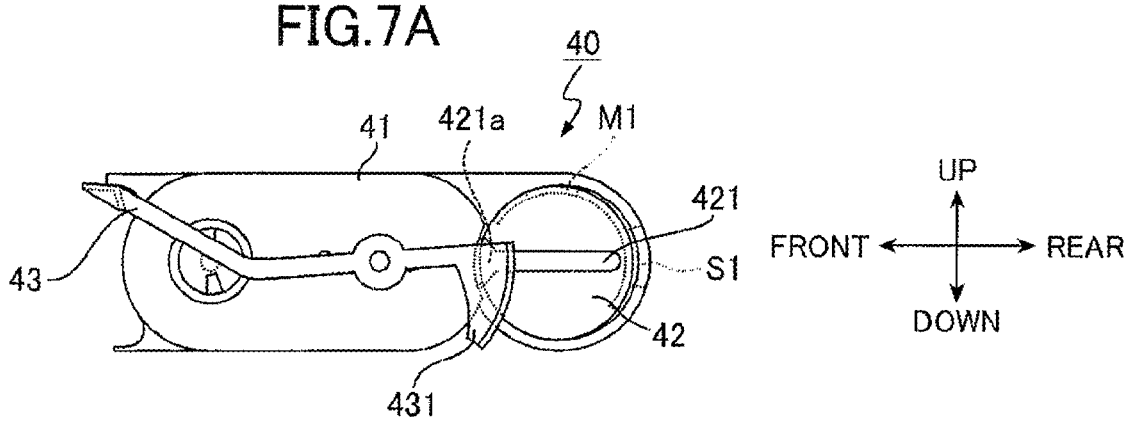

Before the user mounts the toner cartridge 40 on the developer cartridge 50, as shown in FIG. 7A, the orientation of the inner cylinder 42 is set so that the wide parts 421*a* of the protrusions 421 face the front side of the casing 41. At this orientation, the inner cylinder 42 covers the opening S1 formed in the toner cartridge 40. The front ends of the lever members 43 are raised in the uppermost position.

Figure 7B:
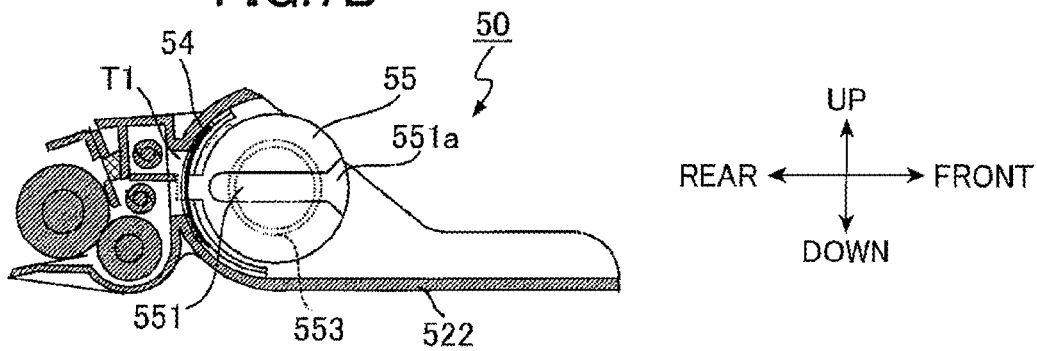
Figure 7C:
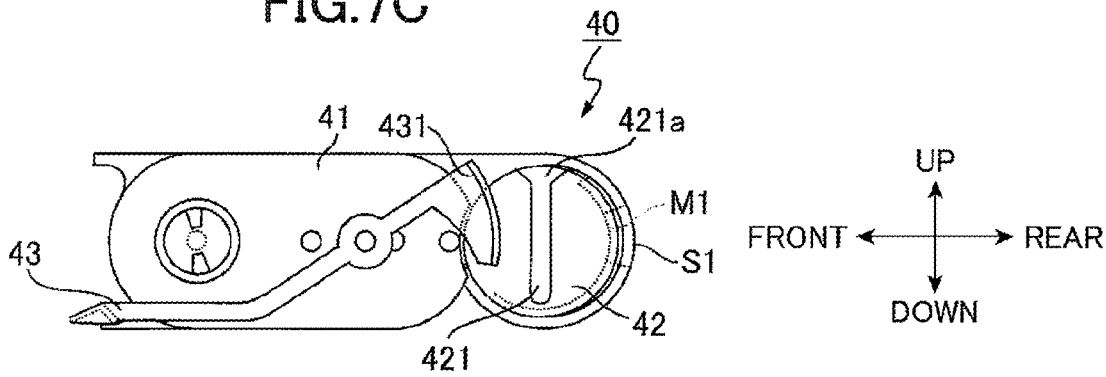

Before the toner cartridge 40 is mounted on the developer cartridge 50, as shown in FIG. 7B, each disc member 55 is oriented so that the wide parts 551*a* of the engaging grooves 551 face forwardly. At this orientation, the shutter 54 covers the opening T1.

The user mounts the toner cartridge 40 on the developer cartridge 50 by horizontally inserting the rear end of the toner cartridge 40 into the front end of the developer cartridge 50 so that the protrusions 421 of the toner cartridge 40 engage in the engaging grooves 551 of the developer cartridge 50. At this time, the teeth formed on the engaging parts 431 of the lever members 43 engage with the teeth formed in the gears 553 of the disc members 55.

Figure 7D:
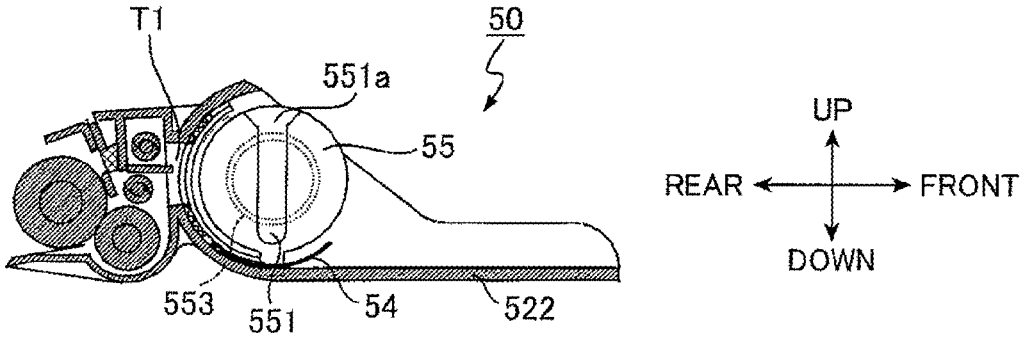

Next, as illustrated in FIG. 7C and FIG. 7D, the user pushes down on the front ends of the lever members 43, causing the disc members 55 of the developer cartridge 50 to rotate in association until the wide parts 551*a* are positioned on the top of the disc members 55. Consequently, the shutter 54 moves down over the bottom wall 522, opening the opening T1. Further, since the protrusions 421 of the toner cartridge 40 are engaged in the engaging grooves 551 of the developer cartridge 50, the rotating operation of the lever members 43 is transferred to both side surfaces of the inner cylinder 42, as well as to the rotation of the disc members 55. Therefore, the inner cylinder 42 rotates until the opening M1 formed in the inner cylinder 42 is positioned opposite the opening S1 formed in the casing 41, thereby opening the opening S1, and the opening M2 formed in the inner cylinder 42 is positioned opposite the opening S2 formed in the casing 41, thereby opening the opening S2.

In this way, in order to mount the toner cartridge 40 having this construction on the developer cartridge 50, the user simply pulls down the front ends of the lever members 43 to rotate the inner cylinder 42, thereby easily opening the opening S1 formed in the toner cartridge 40. To detach the toner cartridge 40 from the developer cartridge 50, the user simply raises the front ends of the lever members 43 to rotate the inner cylinder 42, thereby easily closing the opening S1 formed in the toner cartridge 40.

Figure 8:
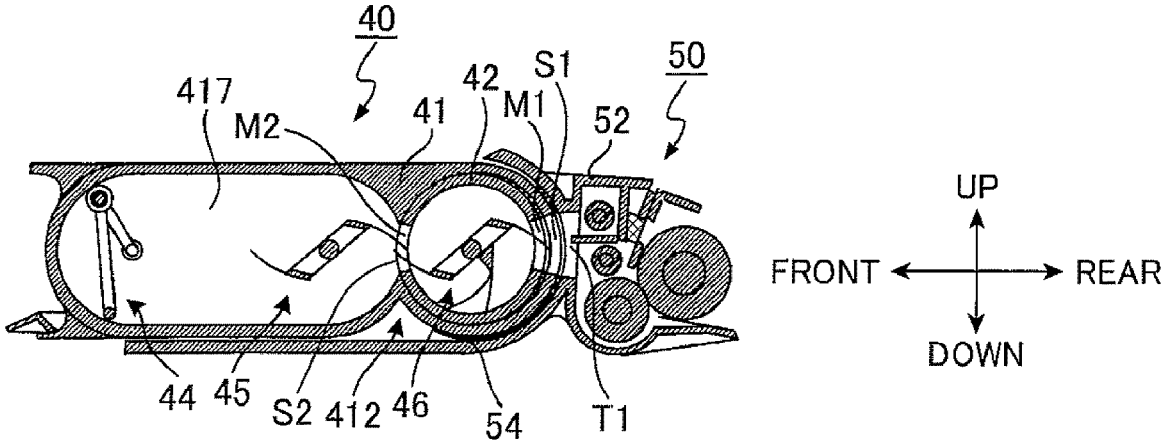
FIG. 8 is a cross-sectional view showing the internal structures of the toner cartridge and the developer cartridge when the toner cartridge is mounted on the developer cartridge and an opening in the toner cartridge and an opening in the developer cartridge are open.

FIG. 8 is a cross-sectional view showing the internal structures of the toner cartridge 40 and the developer cartridge 50 when the toner cartridge 40 is mounted on the developer cartridge 50 and the openings S1 and S2 are open. As shown in FIG. 8, the crank mechanism 44 and agitator 45 in the toner cartridge 40 generate a motive force for conveying toner within the accommodating section 417 toward the inner cylinder 42, while the agitator 46 generates a motive force for conveying toner within the inner cylinder 42 toward the opening S1. Therefore, the toner cartridge 40 can convey toner in a direction substantially orthogonal to the force of gravity (i.e., a horizontal direction).

Since the toner cartridge 40 can supply toner to the developer cartridge 50 in a horizontal direction, it is unnecessary to allocate a large vertical space in the accommodating section 417. By allocating a large horizontal space in the accommodating section 417, it is possible to produce a thinner casing 41 that in turn can contribute to a thinner printer 1, without reducing the toner accommodating capacity.

Since the opening S1 and opening S2 are formed in opposite sides of the cylindrical through-hole 411 and since the opening M1 and opening M2 are formed in opposite sides of the inner cylinder 42, the opening S1, opening M1, opening M2, and opening S2 are all aligned and all in communication with each other when the openings S1 and S2 are opened. Hence, the toner cartridge 40 can efficiently convey toner in the accommodating section 417 to the opening S1 and can therefore efficiently supply toner to the developer cartridge 50.

Further, since the opening M2 has a larger open area than that of the opening M1 in the toner cartridge 40 described above, toner can be more efficiently conveyed into the inner cylinder 42 than discharged out of the casing 41 when the opening S1 is opened. Hence, this toner cartridge 40 prevents the inner cylinder 42 from getting low on toner when a large amount of toner still remains in the accommodating section 417.

Further, by providing the depression 412 in the bottom surface of the casing 41 near the rear end thereof, the shutter 54 can be retracted into the depression 412 when opening the opening T1 in the developer cartridge 50.

Further, by forming the front part 52F of the casing 52 in such a shape that receives the toner cartridge 40 in such a manner as to allow the toner cartridge 40 to convey toner horizontally, the developer cartridge 50 can contribute to a thinner printer 1.

As described above, in the printer 1 of the first embodiment, the toner cartridge 40 is mounted on the developer cartridge 50 in a horizontal direction and toner accommodated in the toner cartridge 40 can be conveyed to the developer cartridge 50 in a horizontal direction, thereby making it possible to manufacture a thinner printer 1 (and specifically a thinner main casing 2).

It is noted, however, that the toner cartridge 40 and the developer cartridge 50 can be mounted in the printer 1 in a direction slightly slanted with respect to the horizontal direction. Still in this case, toner may not be conveyed to the developer cartridge 50 due to a gravitational force similarly to the case where the toner cartridge 40 and the developer cartridge 50 are mounted in the printer 1 horizontally as described above. Even so, it is ensured that the toner cartridge 40 can convey toner in the direction slanted with respect to the horizontal direction toward the developer cartridge 50 by using the motive force generated by the crank mechanism 44 and the agitators 45 and 46.

Further, since the lever members 43 are connected together by the connecting member 433 in the toner cartridge 40 described above, the user can rotate both lever members 43 with one hand. In other words, the user can apply a rotating operation to both ends of the inner cylinder 42 with one hand, thereby further facilitating the opening and closing operation of the opening S1.

Further, since the lever members 43 extend toward the front side of the casing 41 in the toner cartridge 40 described above, the user can rotate the inner cylinder 42 at a point in front of the developer cartridge 50. In other words, the user can easily open and close the opening S1 on the near side of the developer cartridge 50.

In the developer cartridge 50 described above, the disc members 55 move the shutter 54 to a position exposing or covering the opening T1 as the lever members 43 of the toner cartridge 40 are rotated. At the same time, the disc members 55 transfer the rotation of the lever members 43 to both ends of the inner cylinder 42. Accordingly, the opening T1 in the developer cartridge 50 and the openings S1 and S2 in the toner cartridge 40 can be opened and closed simultaneously.

Hence, the developer cartridge 50 having the construction described above reduces the effort needed to open the openings S1, S2, and T1 when mounting the toner cartridge 40 on the developer cartridge 50 and for closing the openings S1, S2, and T1 when detaching the toner cartridge 40 from the developer cartridge 50.

In the first embodiment described above, the crank mechanism 44 and the agitators 45 and 46 receive a motive force from drive shafts on the main casing 2 side to generate a motive force that is applied to the toner. However, the crank mechanism 44 and the agitators 45 and 46 can be configured to generate their own motive force without receiving a motive force from an external drive source.

In the first embodiment described above, the depression 412 is formed in the bottom surface of the casing 41 between the front part 42F and the rear part 42R, but the depression 412 may be formed in the top surface of the casing 41 between the front part 42F and the rear part 42R. In this case, the developer cartridge 50 can be configured to retract the shutter 54 into the depression 412 formed in the top surface of the toner cartridge 40.

Next, variations of the toner cartridge and developer cartridge according to the first embodiment will be described.

First Variation of the First Embodiment

A toner cartridge 60 and a developer cartridge 70 according to a first variation of the first embodiment will be described with reference to FIG. 9A to FIG. 11.

Parts and components in the toner cartridge 60 and developer cartridge 70 the same as those in the toner cartridge 40 and developer cartridge 50 in the first embodiment will be designated with the same reference numerals used in the first embodiment, and a description of these components will not be repeated.

Figure 9A:
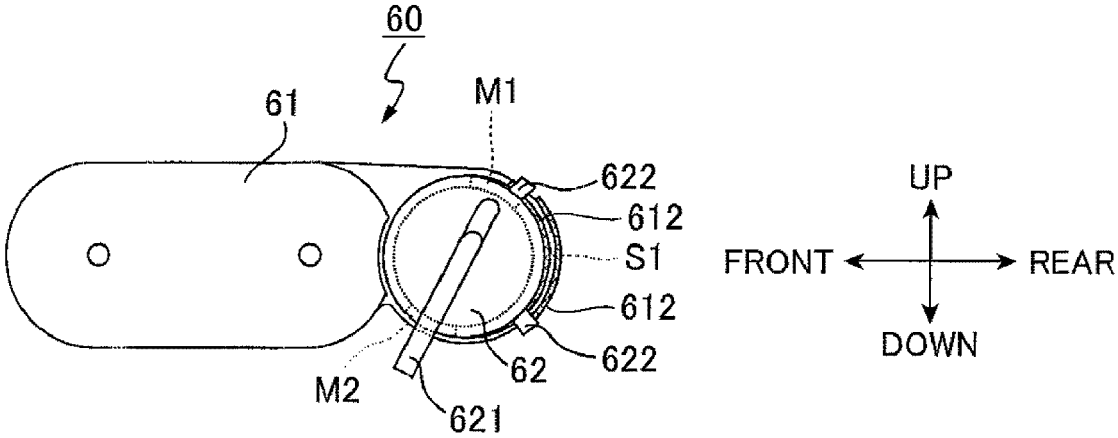
Figure 9B:
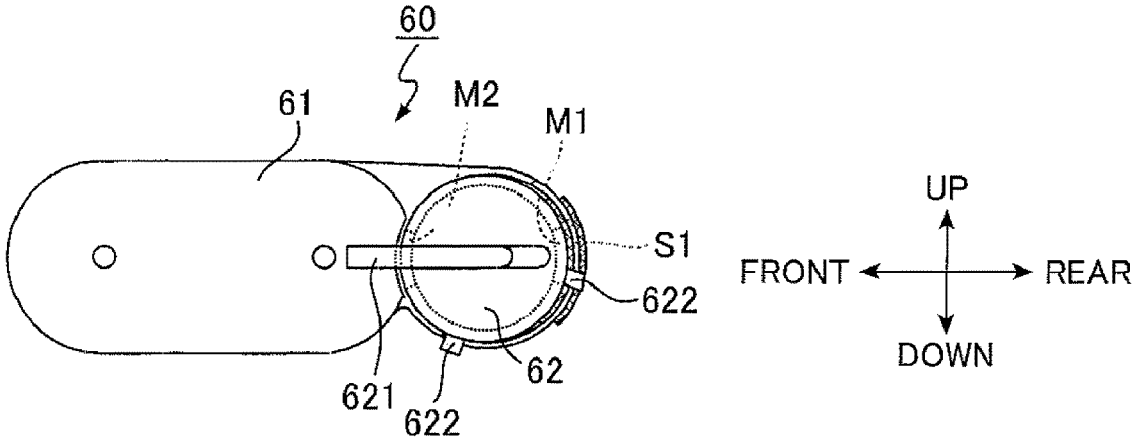
Figure 10A:
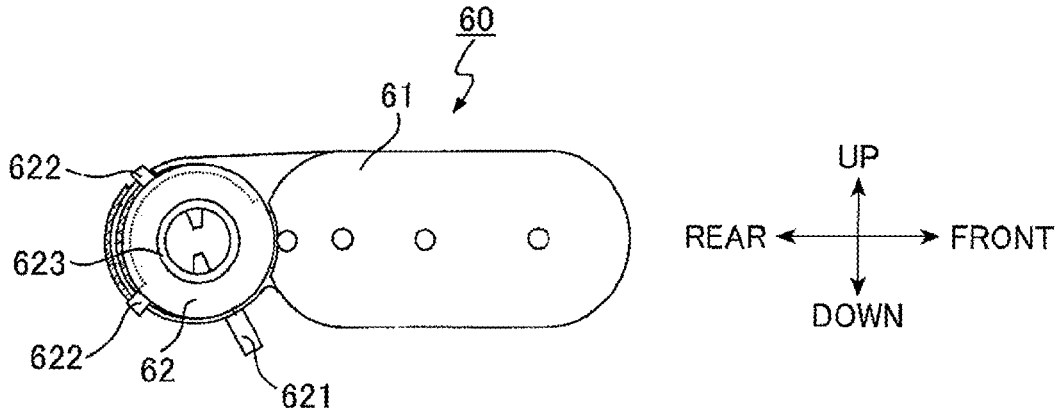
FIG. 10A is a left side view of the toner cartridge of FIG. 9A.
Figure 10B:
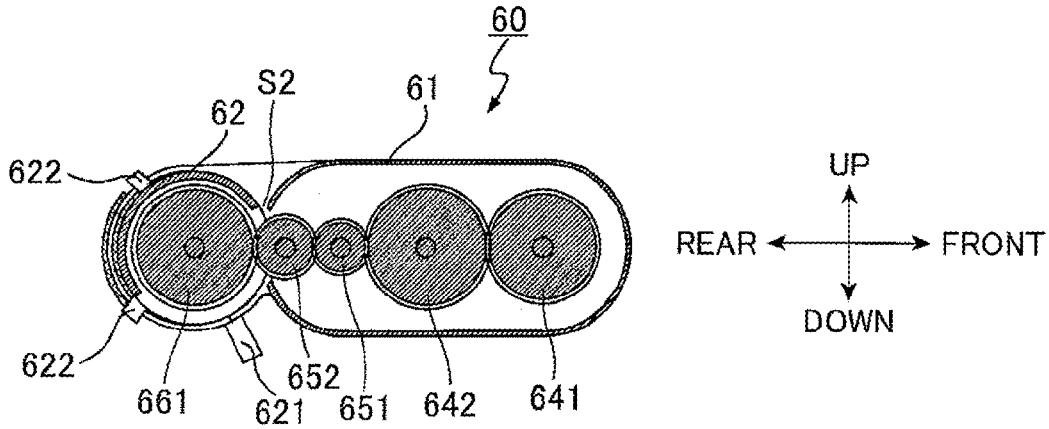
FIG. 10B is a cross-sectional view showing the structure of the toner cartridge of FIG. 9A taken lengthwise through the left end of the toner cartridge and viewed from the left side of the toner cartridge.

FIG. 9A and FIG. 9B show the right side of the toner cartridge 60 according to the first variation of the embodiment. FIG. 9A shows the state of the toner cartridge 60 prior to mounting the toner cartridge 60 on the developer cartridge 70 (FIG. 11), while FIG. 9B shows the state of the toner cartridge 60 after mounting the toner cartridge on the developer cartridge 70. FIG. 10A and FIG. 10B illustrate the left side structure of the toner cartridge 60. FIG. 10A is a left side view of the toner cartridge 60, while FIG. 10B is a cross-sectional view of the toner cartridge 60 taken lengthwise through the left end of the casing 61 and is a view from the left side of the toner cartridge 60.

Similarly to the first embodiment, the toner cartridge 60 includes a casing 61 and an inner cylinder 62.

Although not shown, the casing 61 has an accommodating section in its front part and a cylindrical through-hole in its rear part, similarly to the casing 41 of the first embodiment. The inner cylinder 62 is rotatably mounted in the cylindrical through-hole of the casing 61. The casing 61 is formed with openings S1 and S2 similarly to the casing 41 of the first embodiment. The inner cylinder 62 is formed with openings M1 and M2 similarly to the inner cylinder 42 of the first embodiment. A crank mechanism and an agitator are mounted inside the accommodating section of the casing 61. Another agitator is mounted inside the inner cylinder 62.

According to this modification, however, the casing 61 has no restricting members 414, 415, no lever members 43, or no connecting member 433. No sponge member 416 is provided on the inner surface of the rear wall of the casing 61. Instead, sponge members 612 are provided on both of the outer and inner surfaces of the rear wall of the casing 61 encircling the outer edges of the opening S1.

The inner cylinder 62 protrudes outward from the left and right sides of the casing 61. Two pairs of protrusions 622 are formed on the peripheral surface of the inner cylinder 62. Each pair of protrusions 622 is located on one of the left and right protruding ends of the inner cylinder 62.

No protrusion 421 is provided on the right- or left-side surface of the inner cylinder 62. Instead, a single lever member 621 is provided on the right-side surface of the inner cylinder 62.

The casing 61 has no coupling part 413 on its right side surface. Instead, the inner cylinder 62 has a coupling part 623 on its left side surface. The casing 61 has no gears 441, 442, 451, or 452 on its right side. Instead, the casing 61 has gears 641, 642, 651, and 652 on its left side. The inner cylinder 62 has no gear 461 on its right side. Instead, the inner cylinder 62 has a gear 661 on its left side.

The coupling part 623 has the same configuration with the coupling part 413 in the first embodiment. The gear 661 rotates together with the coupling part 623. The gears 641, 642, 651, 652, and 661 are interconnected in this order. The gears 641 and 651 are coupled to the crank mechanism and the agitator in the accommodating section of the casing 61 similarly to the gears 441 and 451 in the first embodiment. The gear 661 is coupled to the another agitator in the inner cylinder 62 similarly to the gear 461 in the first embodiment. Thus, the gears 661, 652, 651, 642, and 641 cooperate to transfer a drive force received by the coupling part 623 sequentially in this order, thereby supplying the drive force to the agitators and the crank mechanism.

A tip end of the single lever member 621 protrudes from the peripheral edge of the right-side surface of the inner cylinder 62. The tip end of the lever member 621 is located on one side of the inner cylinder 62 on which the opening M2 is provided, and the other opposite end of the lever member 621 is located on the other opposite side of the inner cylinder 62 on which the other opening M1 is provided.

Prior to mounting the toner cartridge 60 on the developer cartridge 70, as shown in FIG. 9A, the inner cylinder 62 is oriented with the tip end of the single lever member 621 protruding from the peripheral edge of the inner cylinder 62 at a slant downwardly toward the front of the casing 61. Accordingly, the opening M2 faces at a slant downwardly toward the front, while the opening M1 faces at a slant upwardly to the rear.

After mounting the toner cartridge 60 on the developer cartridge 70, the user holds the tip end of the single lever member 621 and rotates the single lever member 621 to the state shown in FIG. 9B, where the tip end of the single lever member 621 protrudes horizontally toward the front of the casing 61. Accordingly, the opening M2 faces horizontally toward the front, while the opening M1 faces horizontally to the rear.

The pair of protrusions 622 is formed on each of the left and right protruding ends of the inner cylinder 62 so that one is positioned on the upper rear surface side of the casing 61 and the other on the lower rear surface side of the casing 61 when the inner cylinder 62 is oriented as shown in FIG. 9A and so that one is positioned on the rear surface side of the casing 61 and the other on the bottom surface side of the casing 61 when the inner cylinder 62 is oriented as shown in FIG. 9B.

Accordingly, the opening S1 is closed by the inner cylinder 62 when the inner cylinder 62 is oriented as shown in FIG. 9A and is opened via the opening M1 when the inner cylinder 62 is oriented as shown in FIG. 9B.

Figure 11:
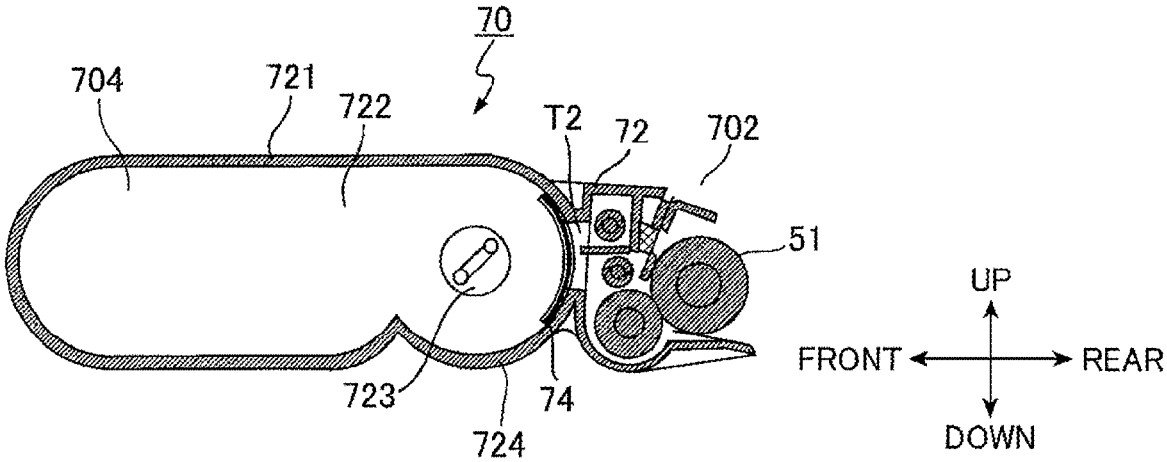
FIG. 11 is a cross-sectional view of a developer cartridge according to the first variation.

FIG. 11 is a cross-sectional view of the developer cartridge 70 according to the first variation of the embodiment. The cross-section of the developer cartridge 70 in FIG. 11 is taken through the left-to-right center of the developer cartridge 70 and is viewed from the right side.

As shown in FIG. 11, the developer cartridge 70 includes a casing 72 and a frame 721 disposed to the front side of the casing 72.

The casing 72 defines therein a developing section 702, in which a developing mechanism 51 is provided in the same manner as in the developing section 502 in the first embodiment.

The frame 721 defines therein a toner-cartridge accommodating section 704 for accommodating the toner cartridge 60. The frame 721 has a cross-sectional shape that conforms to the outer profile of the toner cartridge 60. More specifically, the frame 721 has, on its rear side, a curved wall 724 that is curved or rounded in a shape following the outer shape of the rear part of the casing 61. The left side of the frame 721 is closed by a side wall 722, but the right side is open. Hence, the toner cartridge 60 can be mounted into the developer cartridge 70 from the right side.

A coupling part 723 is provided on the side wall 722 for coupling with a drive shaft on the main casing 2 side. By engaging the coupling part 723 with the coupling part 623 of the toner cartridge 60, the coupling part 723 can transfer a drive force from the drive shaft on the main casing 2 side to the coupling part 623.

An opening T2 is formed in the curved wall 724 of the frame 721 and communicates the interior of the frame 721 with the interior of the casing 72. An elongated shutter 74 is provided on the front surface of the curved wall 724 for covering the opening T2. Although not shown, a sponge member may be fixed on the front surface of the curved wall 724 surrounding the outer edge of the opening T2.

Prior to mounting the toner cartridge 60 in the developer cartridge 70, the inner cylinder 72 is oriented as show in FIG. 9A in the toner cartridge 60, and the opening T2 is closed by the shutter 74 in the developer cartridge 70 as shown in FIG. 11. When the toner cartridge 60 is mounted in the developer cartridge 70, the left end of the elongated shutter 74 is interposed between the pair of protrusions 622 on the left end of the toner cartridge 60 and the right end of the elongated shutter 74 is interposed between the pair of protrusions 622 on the right end of the toner cartridge 60.

When the user rotates the inner cylinder 62 so that the protruding end of the single lever member 621 will be pointed horizontally forwardly as shown in FIG. 9B, the protrusions 622 move the elongated shutter 74 down over the front surface of the curved wall 724, thereby opening the opening T2.

Figure 12A:
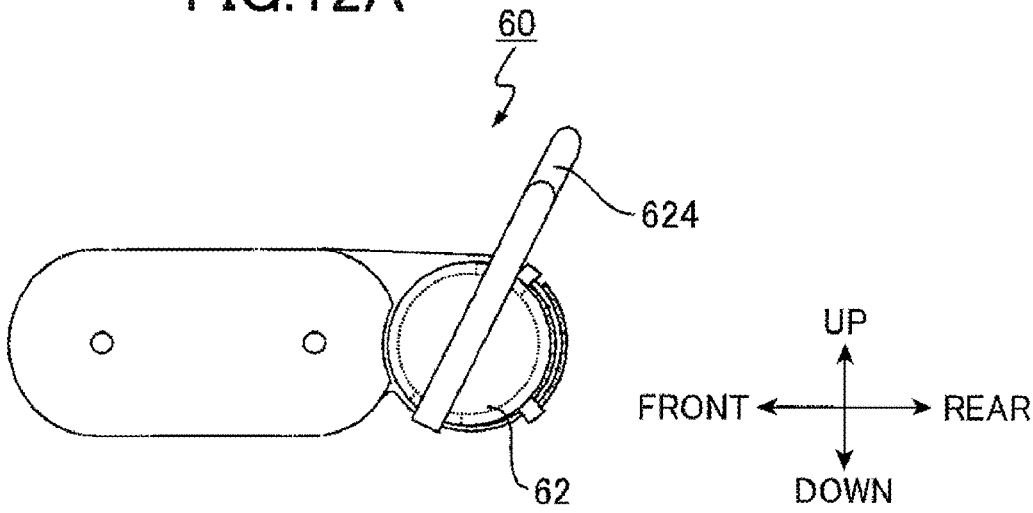
Figure 12B:
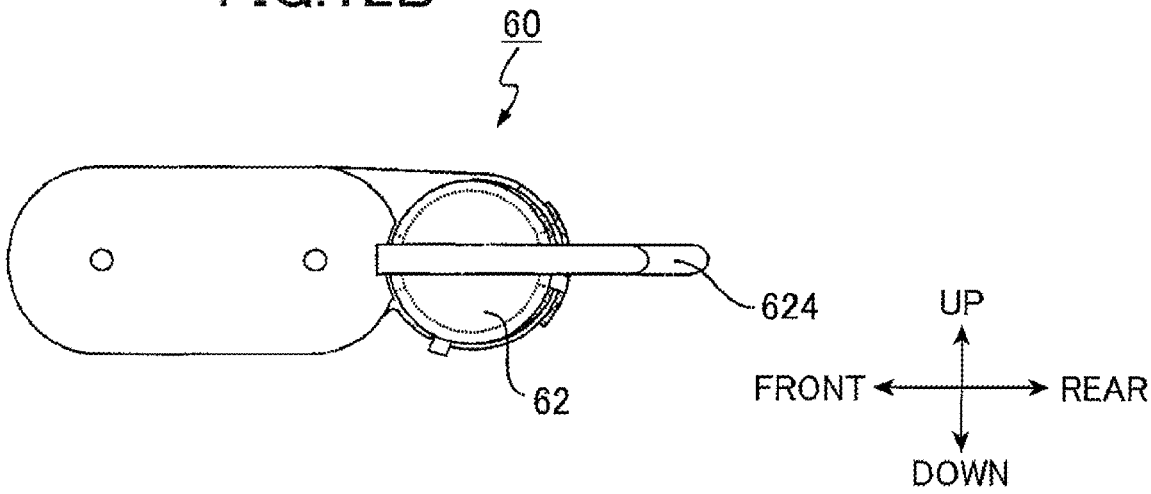

It is noted that as shown in FIG. 12A and FIG. 12B, a lever member 624 may be provided on the right side surface of the inner cylinder 62 in place of the lever member 621. FIG. 12A and FIG. 12B are right side views of the toner cartridge 60 provided with the lever member 624. FIG. 12A shows the state of the toner cartridge 60 prior to being mounted in the developer cartridge 70, while FIG. 12B shows the state of the toner cartridge 60 after being mounted in the developer cartridge 70.

The lever member 624 has a similar shape but is longer than the single lever member 621. The lever member 624 is provided on the right-side surface of the inner cylinder 62. A tip end of the lever member 624 protrudes from the peripheral edge of the right side surface of the inner cylinder 62. The tip end of the lever member 624 is pointed at a slant upwardly to the rear before the toner cartridge 60 is mounted in the developer cartridge 70. After the toner cartridge 60 is mounted in the developer cartridge 70, when the user rotates the lever member 624, the tip end of the lever member 624 is pointed horizontally to the rear to face the developer cartridge 70 side.

In this variation, the lever member 624 is formed of an electrically conducting member. When the toner cartridge 60 is mounted on the developer cartridge 70, the lever member 624 contacts the developer cartridge 70 to establish electrical conduction between the toner cartridge 60 and developer cartridge 70. Hence, use of the lever member 624 can reduce the wiring inside the main casing 2.

Second Variation of the First Embodiment

A toner cartridge 80 and a developer cartridge 90 according to a second variation of the first embodiment will be described with reference to FIG. 13A to FIG. 15B.

Figure 13A:
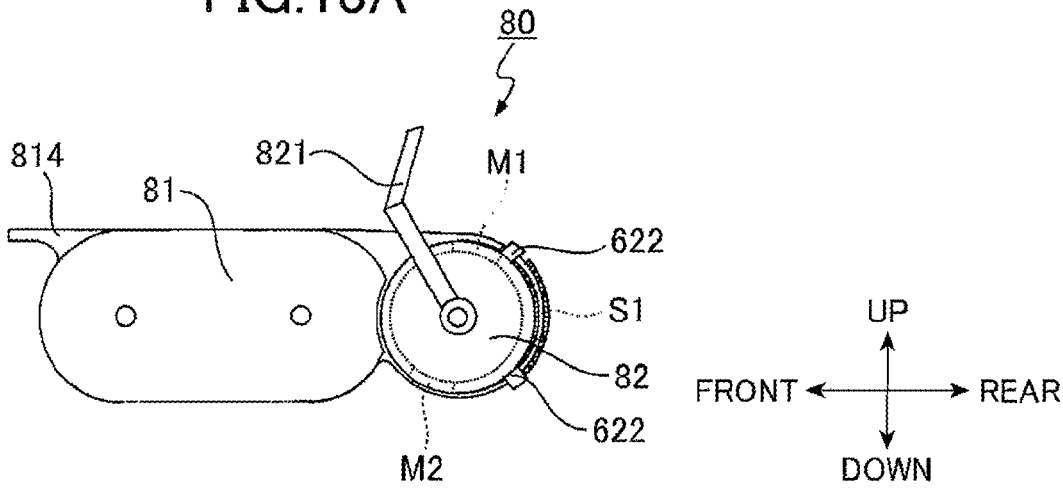
Figure 13B:
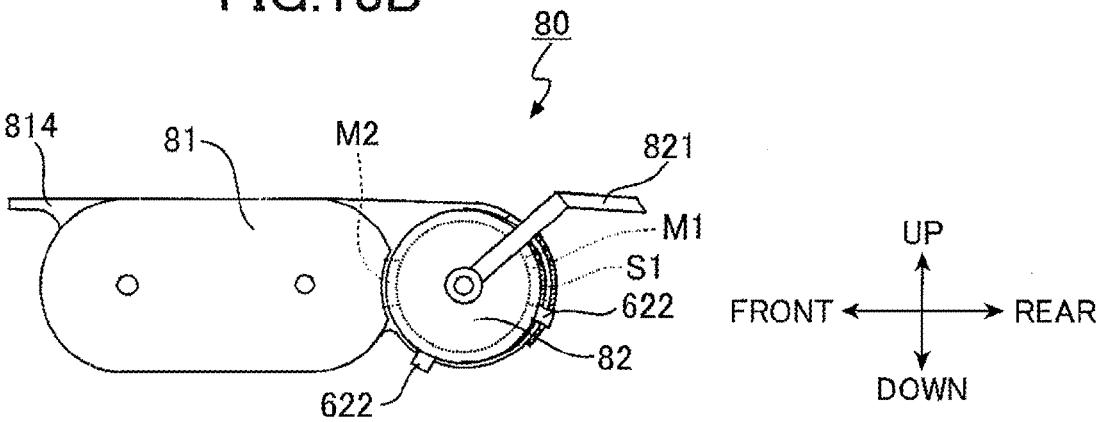

FIG. 13A and FIG. 13B are right side views of the toner cartridge 80 according to the second variation of the first embodiment. FIG. 13A shows the state of the toner cartridge 80 prior to being mounted on the developer cartridge 90 (FIG. 14) according to the second variation of the first embodiment, while FIG. 13B shows the state of the toner cartridge 80 after being mounted on the developer cartridge 90.

Parts and components in the toner cartridge 80 the same as those in the toner cartridge 60 in the first variation of the first embodiment will be designated with the same reference numerals used in the first variation of the first embodiment, and a description of these components will not be repeated.

As shown in FIG. 13A, the toner cartridge 80 includes a casing 81 and an inner cylinder 82.

The casing 81 has the same configuration as the casing 61 in the first variation except that the casing 81 has a restricting member 814 on the upper edge at the front surface thereof.

The inner cylinder 82 is the same as the inner cylinder 62 in the first variation except that a pair of lever members 821 is provided on the inner cylinder 82 instead of the single lever member 621. The pair of lever members 821 is provided on the inner cylinder 82, with one on each side surface thereof.

The base end of each lever member 821 is fixed to the center region of a side surface of the inner cylinder 82, while the tip end protrudes beyond the peripheral edge of the side surface. Each lever member 821 is bent at its middle portion. When the base end of the lever member 821 extends at a slant upwardly to the front as shown in FIG. 13A, the tip end of the lever member 821 points upward. Contrarily, when the base end of the lever member 821 extends at a slant upwardly to the rear as shown in FIG. 13B, the tip end of the lever member 821 points rearward.

Similarly to the first variation of the first embodiment, the protrusions 622 are formed on each of the left and right sides of the inner cylinder 82 such that one is positioned on the upper rear side of the casing 81 and the other on the lower rear side of the casing 81 when the inner cylinder 82 is oriented with the tip end of the lever member 821 pointing upward as shown in FIG. 13A and such that one is positioned on the rear side of the casing 81 and the other on the bottom side of the casing 81 when the inner cylinder 82 is oriented with the tip end of the lever member 821 pointing rearward as shown in FIG. 13B.

Figure 14:
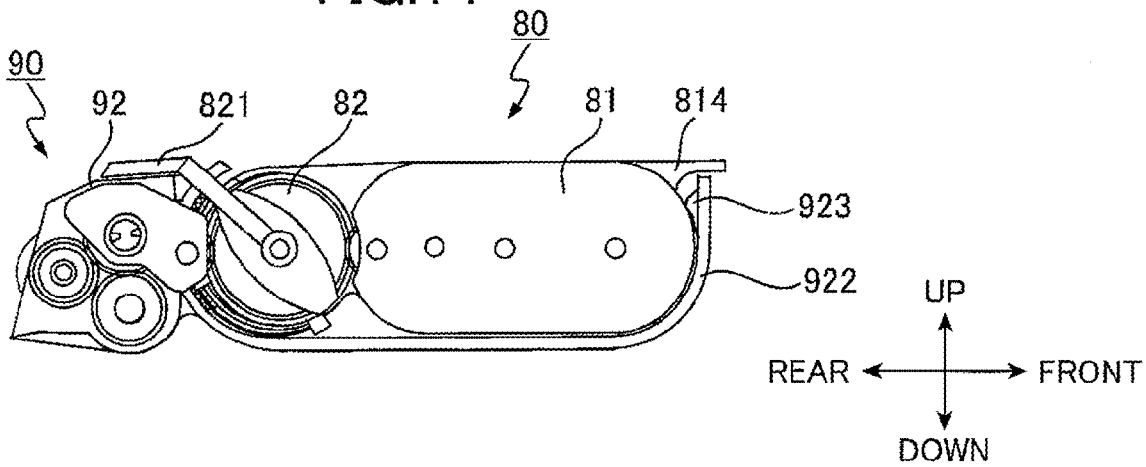
FIG. 14 is a left side view of a developer cartridge according to the second variation when the toner cartridge is mounted thereon.

FIG. 14 is a left side view of the developer cartridge 90 according to the second variation of the first embodiment when the toner cartridge 80 is mounted on the developer cartridge 90.

Parts and components in the developer cartridge 90 the same as those in the developer cartridge 50 in the first embodiment will be designated with the same reference numerals used in the first embodiment, and a description of these components will not be repeated.

As shown in FIG. 14, the developer cartridge 90 has a casing 92.

The casing 92 is the same as the casing 52 of the developer cartridge 50 in the first embodiment except that the casing 92 has no side walls 521 and that the casing 92 has a bottom wall 922 in place of the bottom wall 522.

The bottom wall 922 has such a shape that is obtained by modifying the bottom wall 522 by extending the bottom wall 522 to the front surface of the toner cartridge 80 and subsequently bending the bottom wall 522 upward along the front surface of the toner cartridge 80 so that the toner cartridge 80 can be mounted in the casing 92 from above. A locking member 923 is formed on the top edge of the upwardly-bent bottom wall 922 in a region that is contacted by the front surface of the toner cartridge 80. The locking member 923 is for fixing the toner cartridge 80 in the casing 92. More specifically, the locking member 923 fixes an end part on the front surface of the casing 81 in the casing 92 when the toner cartridge 80 is mounted in the developer cartridge 90.

A rear end of the casing 81 is fixed to the casing 92 by interposing the casing 92 between the protruding ends of the pair of lever members 821.

Figure 15A:
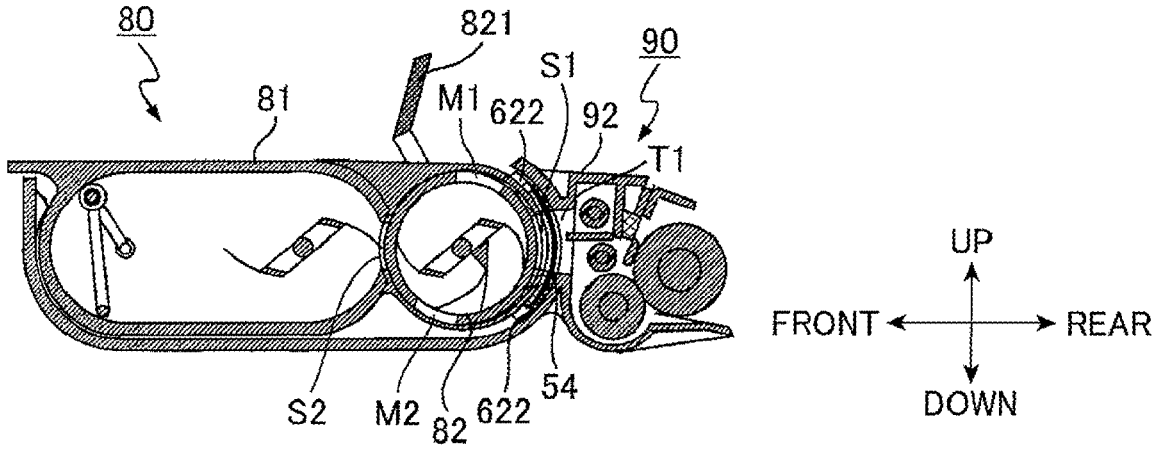
Figure 15B:
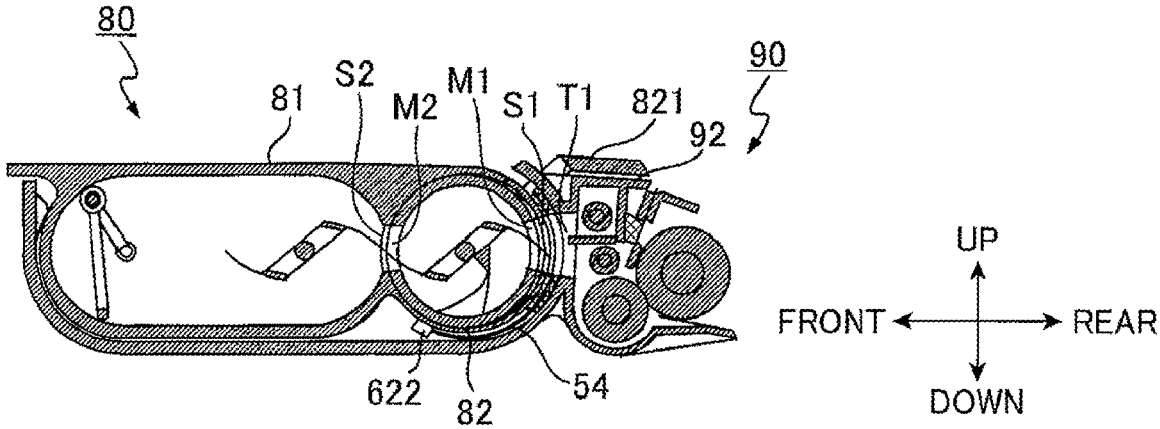

FIG. 15A and FIG. 15B are cross-sectional views showing the internal state of the toner cartridge 80 and the developer cartridge 90. FIG. 15A shows the internal state of the toner cartridge 80 and developer cartridge 90 when the tip ends of the lever members 821 are pointed upward as shown in FIG. 13A, while FIG. 15B shows the internal state of the toner cartridge 80 and developer cartridge 90 when the tip ends of the lever members 821 are pointed horizontally to the rear as shown in FIG. 13B.

When the tip ends of the lever members 821 are pointing upward, the opening S1 of the casing 81 is closed by the peripheral wall of the inner cylinder 82 as shown in FIG. 15A. At this time, the shutter 54 in the casing 92 covers the opening T1.

When the inner cylinder 82 is rotated so that the tip ends of the lever members 821 are pointed horizontally to the rear, the opening S1 is opened by the opening M1 as shown in FIG. 15B. When the inner cylinder 82 is rotated in this way, the protrusions 822 of the toner cartridge 80 move the shutter 54 down over the lower surface of the toner cartridge 80, thereby opening the opening T1.

Second Embodiment

Figure 16:
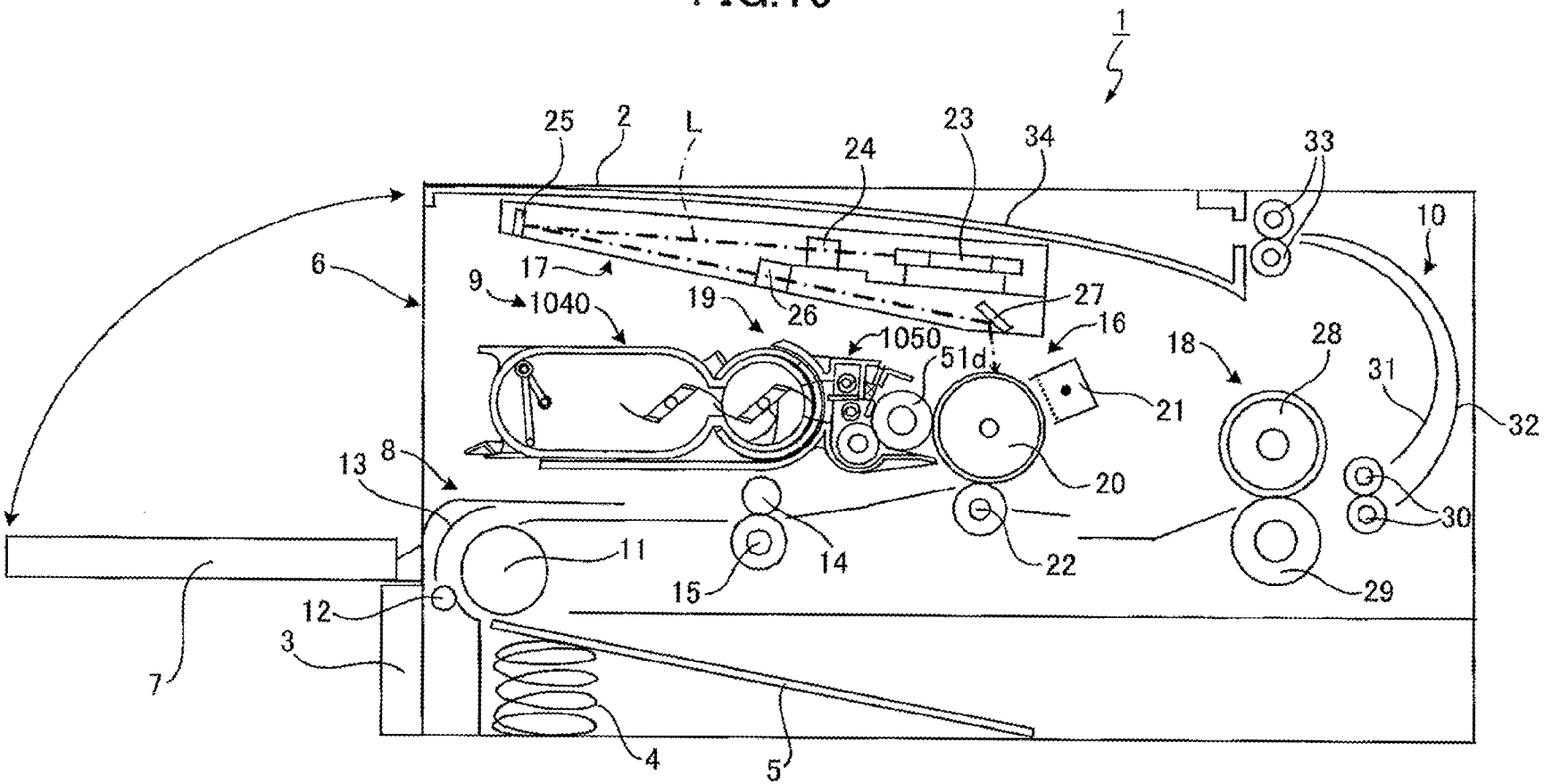
FIG. 16 is a cross-sectional view showing an internal structure of a printer according to a second embodiment of the invention.

Next, a second embodiment of the present invention will be described. FIG. 16 shows the structure of a printer 1001 according to the second embodiment. According to the present embodiment, a toner cartridge 1040 and a developer cartridge 1050 are used instead of the toner cartridge 40 and the developer cartridge 50 according to the first embodiment. Except for the toner cartridge 1040 and developer cartridge 1050, the printer 1001 is identical in structure and in function to the printer 1 described in the first embodiment. Accordingly, parts and components in the printer 1001 not constituting the toner cartridge 1040 and developer cartridge 1050 will be designated with the same reference numerals used for the printer 1 in the first embodiment, and a description of these components will not be repeated.

Next will be described the toner cartridge 1040 with reference to FIG. 17A-FIG. 19C.

Although the toner cartridge 40 of the first embodiment includes the casing 41 and the inner cylinder 42 provided inside the casing 41, the toner cartridge 1040 includes a casing 1041 and an outer semicylinder 1042 provided outside the casing 1041.

Figure 17A:
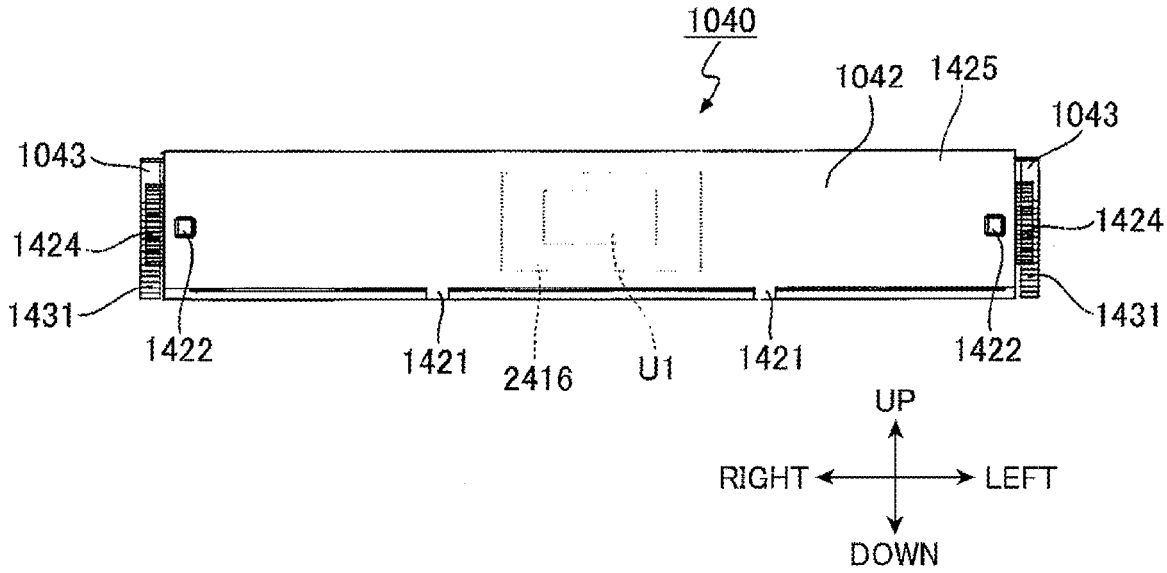
FIG. 17A is a rear view showing a toner cartridge used in the printer of FIG. 16.
Figure 17B:
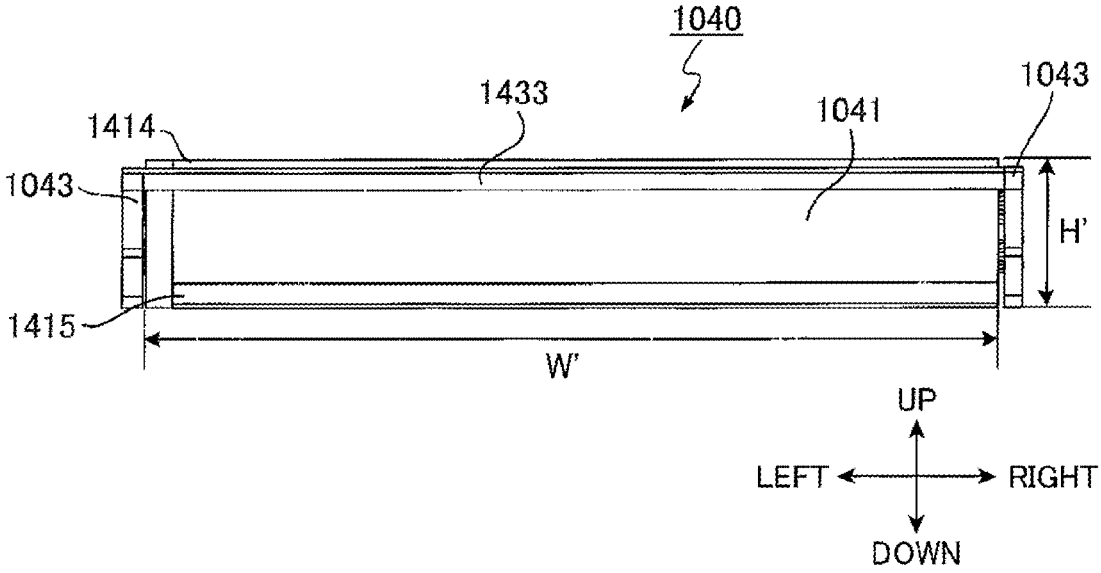
FIG. 17B is a front view of the toner cartridge.
Figure 18A:
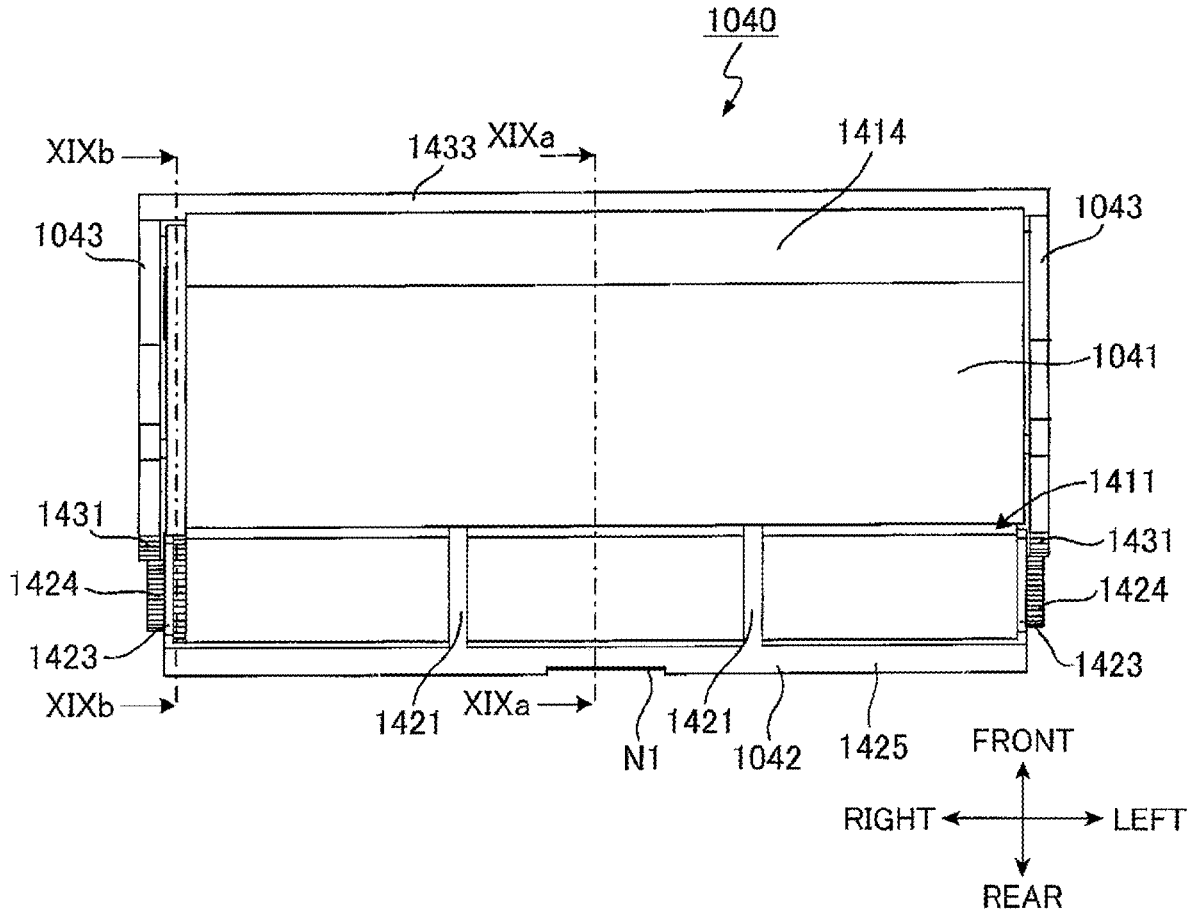
FIG. 18A is a plan view of the toner cartridge.
Figure 18B:
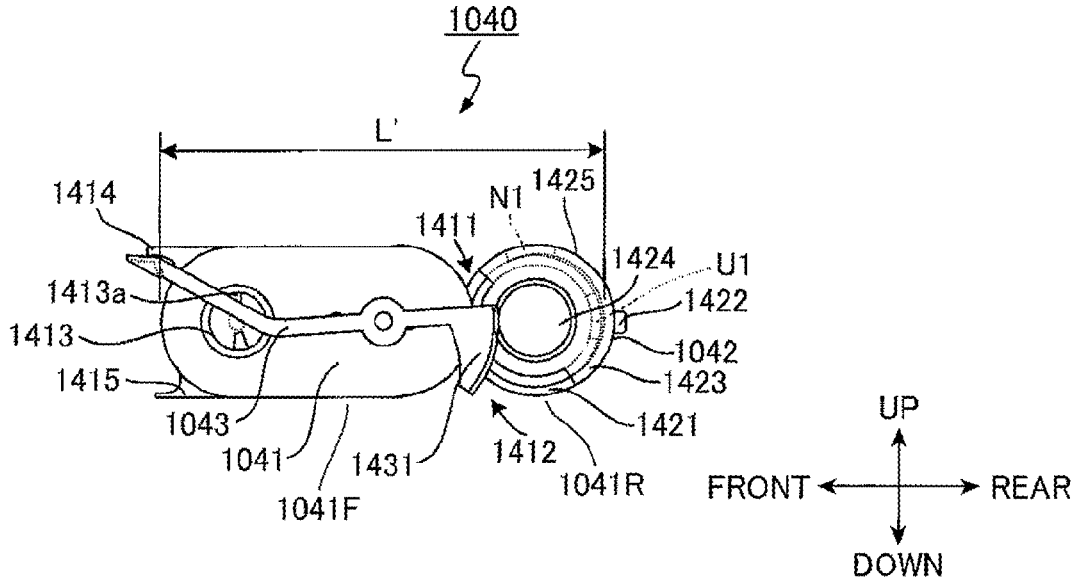
FIG. 18B is a right side view of the toner cartridge.

FIG. 17A, FIG. 17B, FIG. 18A, and FIG. 18B show the outer appearance of the toner cartridge 1040, wherein FIG. 17A is a rear view of the toner cartridge 1040, FIG. 17B a front view of the toner cartridge 1040, FIG. 18A a plan view of the toner cartridge 1040 seen from above, and FIG. 18B a right side view of the toner cartridge 1040. FIG. 17A, FIG. 17B, and FIG. 18B show the toner cartridge 1040 when the front ends of lever members 1043 (to be described later) are in contact with an upper restricting member 1414 (to be described later), while FIG. 18A shows the toner cartridge 1040 when the front ends of lever members 1043 are in contact with a lower restricting member 1415 (to be described later).

Figure 19A:
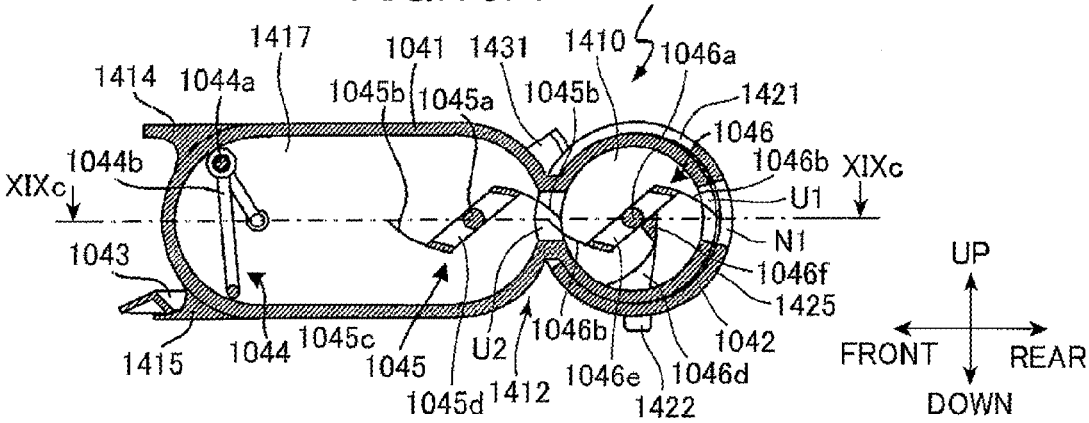
FIG. 19A is a cross-sectional view of the toner cartridge taken along a line XIXa-XIXa in FIG. 18A, showing the internal structure of the toner cartridge.
Figure 19B:
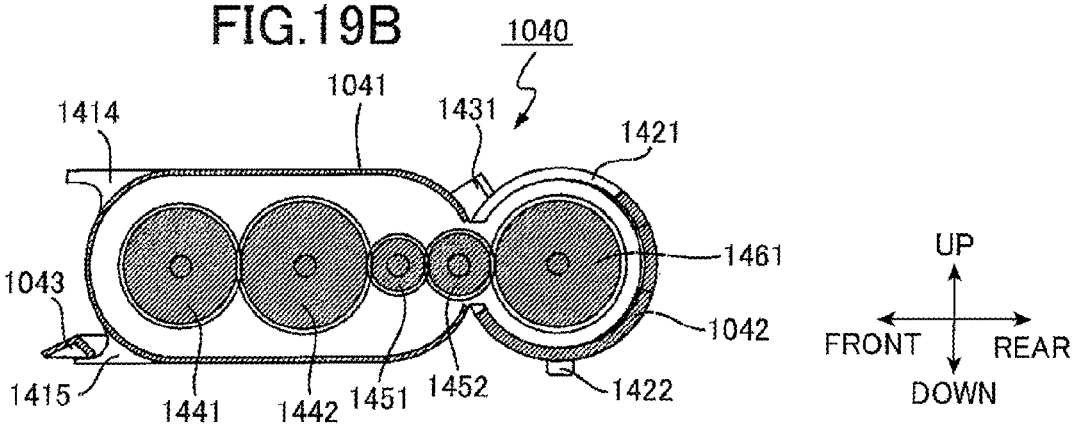
FIG. 19B is a cross-sectional view of the toner cartridge taken along a line XIXb-XIXb in FIG. 18A, showing the internal structure of the toner cartridge.
Figure 19C:
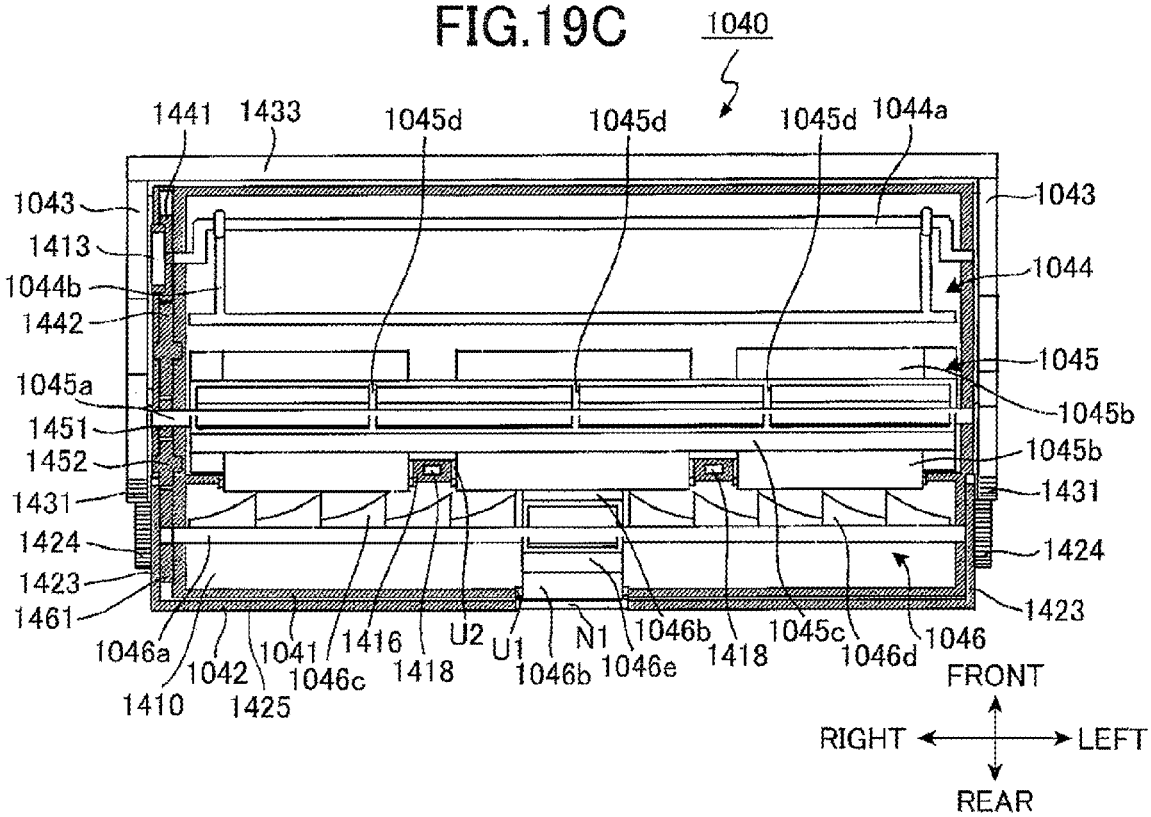
FIG. 19C is a plan view of the toner cartridge with a partial cross-section taken along a plane XIXc-XIXc shown in FIG. 19A, showing the internal structure of the toner cartridge.

FIG. 19A and FIG. 19B are cross-sectional views showing the internal structure of the toner cartridge 1040. FIG. 19A is a cross-sectional view taken longitudinally through the widthwise center of the toner cartridge 1040 and viewed from the right side, as indicated by the arrows XIXa in FIG. 18A. FIG. 19B is a cross-sectional view taken longitudinally through the toner cartridge 1040 at the right edge of the casing 1041 and is viewed from the right side, as indicated by arrows XIXb in FIG. 18A. FIG. 19C is a plan view of the toner cartridge 1040 with a partial cross-section (only of the casing 1041) taken along a plane XIXc-XIXc shown in FIG. 19A through the center of the casing 1041 with respect to the height thereof. All of these drawings of FIG. 19A-FIG. 19C show the interior of the casing 1041 in a state in which the front ends of the lever members 1043 are lowered until the lever members 1043 contact the restricting member 1415 to cause the outer semicylinder 1042 to rotate so that an opening N1 (to be described later) of the outer semicylinder 1042 faces horizontally rearwardly (to be described later with reference to FIG. 21C).

Similarly to the casing 41 in the first embodiment, as shown in FIG. 17A-FIG. 18B, the casing 1041 is in a flat shape so that a length L' (see FIG. 18B) in a horizontal direction running from the front surface to the rear surface and a width W' (see FIG. 17B) running in a horizontal direction from the left side surface to the right side surface are set greater than a height H' (see FIG. 17B) running vertically from the bottom surface to the top surface. More specifically, the casing 1041 is in a wide shape in which the width W' is about twice as large as the length L'.

Similarly to the depression 412 in the first embodiment, a depression 1412 is formed in the bottom surface of the casing 1041 as shown in FIG. 18B. Another depression 1411 is further formed in the top surface of the casing 1041.

The casing 1041 has a front part 1041F and a rear part 1041R, with the depressions 1412 and 1411 being located between the front part 1041F and the rear part 1041R.

The front part 1041F has the same configuration with the front part 41F of the first embodiment. That is, the front part 1041F is rounded or curved at its front side projecting outwardly horizontally to the front. An accommodating section 1417 is formed as a space inside the front part 1041F of the casing 41. The accommodating section 1417 is for accommodating toner therein.

The pair of lever members 1043 is pivotably supported in the front part 1041F on both side surfaces thereof. The pair of lever members 1043 is pivotably supported at the approximate lengthwise center of the casing 1041. The pair of lever members 1043 is the same as the pair of lever members 43 of the first embodiment in configuration and in function. Each lever member 1043 has an engaging part 1431 of an arched plane-shape on its rear end. Similarly to the engaging part 431 in the first embodiment, the engaging part 1431 is formed with a plurality of teeth on its outer edge facing toward the rear. Similarly to the connecting member 433 in the first embodiment, a connecting member 1433 is integrally formed on the front ends of the lever members 1043 for connecting the lever members 1043 with each other.

Restricting members 1414 and 1415 are provided on upper and lower edges on the front surface of the casing 1041. The restricting members 1414 and 1415 are the same as the restricting members 414 and 415 in the first embodiment.

A coupling part 1413 is provided on the right side surface of the casing 1041. The coupling part 1413 is the same as the coupling part 413 of the first embodiment in configuration and in function. That is, the coupling part 1413 is cylindrical in shape and has a pair of protrusions 1413*a* on the inner peripheral edge of the coupling part 1413 at opposing positions for engaging with the drive shaft on the main casing 2 side.

The rear part 1041R is rounded or curved, at its rear side projecting outwardly horizontally to the rear, at its bottom side projecting vertically downwardly, and further at its top side projecting vertically upwardly. In other words, a portion of the rear part 1041R that ranges from the top through the rear to the bottom of the rear part 1041R is substantially of a semicylindrical shape, whose central axis extends in the widthwise direction of the casing 1041. The depression 1412 is formed on the bottom surface of the casing 1041 continuously with the curved bottom surface of the rear part 1041R. The depression 1411 is formed on the top surface of the casing 1041 continuously with the curved top surface of the rear part 1041R.

As shown in FIG. 19A, a cylindrical hole 1410 is formed inside the rear part 1041R of the casing 1041. The cylindrical hole 1410 extends in the width direction, and is closed at its pair of opposite sides (left and right sides). The central axis of the cylindrical hole 1410 is in alignment with the central axis of the semicylindrically-curved outer surface of the rear part 1041R. Thus, the outer surface of the wall in the rear part 1041R is curved following the inner surface of the wall in the rear part 1041R surrounding the cylindrical hole 1410.

The casing 1041 has an opening U1 in its rear part 1041R. The opening U1 is located in a widthwise and vertical center region of the curved rear wall of the casing 1041, facing horizontally rearwardly. The opening U1 is formed through the rear wall of the casing 1041. The opening U1 is in communication with the cylindrical hole 1410, and allows communication between the interior and exterior of the casing 1041. The opening U1 is formed in an elongated planar shape that is elongated in the width direction of the casing 1041.

An opening U2 is formed inside the casing 1041 between the accommodating section 1417 and the cylindrical hole 1410 in communication with both of the accommodating section 417 and the cylindrical hole 1410. The opening U2 is provided at a location between the depressions 1412 and 1411. The openings U1 and U2 oppose each other with the cylindrical hole 1410 being located therebetween. The accommodating section 1417 is formed extending horizontally from the front surface of the casing 1041 to the opening U2. The accommodating section 1417 is in communication with the cylindrical hole 1410 via the opening U2. The opening U2 is located opposing the opening U1 horizontally. The opening U1, the central axis of the cylindrical hole 1410 (that is, the central axis of the curved outer peripheral surface of the rear part 1041R), and the opening U2 are arranged in line in the horizontal direction. The opening U2 has the same elongated planar shape as the opening U1 but is longer in the width direction of the casing 1041.

As shown in FIG. 17A, a sponge member 2416 is provided on the outer surface of the rear part 1041R of the casing 1041 surrounding the outer edge of the opening U1.

The outer semicylinder 1042 is mounted on the rear part 1041R of the casing 1041. More specifically, the outer semicylinder 1042 is of a semicylindrical shape, and has: a peripheral wall 1425 that follows the outer peripheral surface of the rear part 1041R of the casing 1041; and a pair of opposite side walls (right-side and left-side walls) 1423 of a semicircular shape (FIG. 18B) located on the left and right sides of the peripheral wall 1425 of the outer semicylinder 1042. The outer semicylinder 1042 is mounted on the rear part 1041R of the casing 1041, with its central axis being in alignment with the central axis of the curved outer peripheral surface of the rear part 1041R of the casing 1041. The peripheral wall 1425 of the outer semicylinder 1042 extends substantially parallel to the central axis of the outer semicylinder 1042, while the semicircular side walls 1423 of the outer semicylinder 1042 are arranged opposing each other along the central axis of the outer semicylinder 1042.

Gears 1424, each having a circular shape, are fixed on the outer sides of the pair of opposite side walls 1423. The gears 1424 are centered on the central axis of the outer semicylinder 1042. The teeth on the gear 1424 are engaged with the teeth formed on the engaging part 1431 of each lever member 1043. When the gears 1424 rotate, the outer semicylinder 1042 rotates in association about its central axis relative to the rear part 1041R of the casing 1041.

A pair of arc-shaped members 1421 that curve along the outer peripheral surface of the rear part 1041R of the casing 1041 extend between an upper edge and a lower edge of the peripheral wall 1425 along the circumferential direction around the central axis of the outer semicylinder 1042. The outer semicylinder 1042, together with the arc-shaped members 1421, surround the rear part 1041R of the casing 1041. Thus, the outer semicylinder 1042 is mounted on the rear part 1041R of the casing 1041 and is capable of rotating so that the inner surface of the peripheral wall 1425 follows the outer peripheral surface of the rear part 1041R of the casing 1041.

As shown in FIG. 19A, the opening N1 is formed in the peripheral wall 1425 at a location between the upper edge and a center position between the upper and lower edges of the peripheral wall 1425, penetrating the peripheral wall 1425. The opening N1 is located in the widthwise center of the outer semicylinder 1042. The opening N1 has substantially the same planar shape and the same open area as the opening U1 formed in the casing 1041.

The outer semicylinder 1042 also includes a pair of protrusions 1422. As shown in FIG. 17A, the protrusions 1422 are formed one each on the left end and the right end of the peripheral wall 1425 at a position between the lower edge and a center position between the upper and lower edges of the peripheral wall 1425.

When the outer semicylinder 1042 is rotated so that the lower edge of the outer semicylinder 1042 abuts against the outer surface of the casing 1041 at its depression 412 as shown in FIG. 19A, the protrusions 1422 move to the bottom surface of the casing 1041, and the opening N1 is aligned with the opening U1 formed in the casing 1041 and is therefore in communication with the interior of the casing 1041.

As shown in FIG. 19C, the casing 1041 has a pair of arc-shaped inner walls 1416 that extend in the opening U2. Each arc-shaped inner wall 1416 has an insertion path 1418 therein for receiving the corresponding arc-shaped member 1421 therein. Thus, the opening U2 is divided into three sections by the pair of arc-shaped inner walls 1416 as shown in FIG. 19C. However, the opening U2 totally has such a shape that is elongated similarly to the opening U1, and has the total open area greater than that of the opening U1.

The casing 1041 has a crank mechanism 1044, the agitators 1045 and 1046, and gears 1441, 1442, 1451, 1452, and 1461.

The crank mechanism 1044 is the same as the crank mechanism 44 in the first embodiment in configuration and in function. That is, the crank mechanism 1044 is configured of a crankshaft 1044*a* and a suspended member 1044*b* that are the same as the crankshaft 44*a* and suspended member 44*b* in the first embodiment.

The agitator 1045 is configured of a rotational shaft 1045*a*, and a pair of film members 1045*b*. The rotational shaft 1045*a* is formed with a frame 1045*c* and dividers 1045*d*. The rotational shaft 1045*a*, frame 1045*c*, and dividers 1045*d* are the same as the rotational shaft 45*a*, frame 45*c*, and dividers 45*d* in the first embodiment in configuration and in function. The pair of film members 1045*b* are the same as the pair of film members 45*b* in the first embodiment except that the protruding end of each film member 1045*b* is divided into three sections so as to be capable of penetrating the three divisions of the opening U2.

The agitator 1046 is the same as the agitator 46 in the first embodiment in configuration and in function except that the agitator 1046 is mounted in the casing 1041, although the agitator 46 is mounted in the inner cylinder 42 in the first embodiment. That is, the agitator 1046 includes a rotational shaft 1046*a* formed with a frame 1046*e* and a pair of protrusions 1046*f*, a pair of film members 1046*b*, and a right-side serrated film member 1046*c* and a left-side serrated film member 1046*d*. The rotational shaft 1046*a* is the same as the rotational shaft 46*a* in the first embodiment in configuration and in function except that the rotational shaft 1046*a* extends from the left side to the right side of the casing 1041, with the left end inserted through the left side wall of the casing 1041, and the right end coupled with the center part of the gear 1461 disposed inside the right side wall of the casing 1041. The frame 1046*e*, the pair of protrusions 1046*f*, the pair of film members 1046*b*, and the right-side serrated film member 1046*c* and the left-side serrated film member 1046*d* are the same as the frame 46*e*, the pair of protrusions 46*f*, the pair of film members 46*b*, and the right-side serrated film member 46*c* and the left-side serrated film member 46*d* in the first embodiment in configuration and in function except that the frame 1046*e*, the pair of protrusions 1046*f*, the pair of film members 1046*b*, and the right-side serrated film member 1046*c* and the left-side serrated film member 1046*d* are located inside the casing 1041, although the frame 46*e*, the pair of protrusions 46*f*, the pair of film members 46*b*, and the right-side serrated film member 46*c* and the left-side serrated film member 46*d* are located inside the inner cylinder 42 in the first embodiment.

With the agitator 1046 having this construction, as the rotational shaft 1046*a* rotates, the right-side serrated film member 1046*c* and left-side serrated film member 1046*d* agitate toner near both right and left edges within the casing 1041 to generate a motive force for scraping the toner toward the center region of the casing 1041. Further, the frame 1046*e* and film members 1046*b* of the rotational shaft 1046*a* agitate toner in the center region of the casing 1041 and generate a motive force for conveying this toner toward the opening U1.

Similarly to the gear 441 in the first embodiment, the gear 1441 rotates together with the coupling part 1413, and is coupled with the crankshaft 1044*a*.

Similarly to the gear 441 in the first embodiment, the gear 1451 is coupled with the rotational shaft 1045*a*.

Similarly to the gear 451 in the first embodiment, the gear 1451 is engaged with a gear 1442, which in turn is engaged with the gear 1441. The gear 1442 has substantially the same diameter as the gear 1441, while the gear 1451 has a smaller diameter than the gear 1442.

Similarly to the gear 461 in the first embodiment, the gear 1461 is coupled with the rotational shaft 1046*a*.

Similarly to the gear 452 in the first embodiment, the gear 1452 is engaged with the gear 1451. The gear 1452 has a diameter substantially the same as the gear 1451, and the gear 1461 has a diameter substantially the same as the gear 1441 and gear 1442.

In the toner cartridge 1040 having this construction, the drive shaft on the main casing 2 side causes the gear 1441 to rotate counterclockwise in FIG. 19B. Accordingly, the crankshaft 1044*a* of the crank mechanism 1044, the rotational shaft 1045*a* of the agitator 1045, and the rotational shaft 1046*a* of the agitator 1046 all rotate in the counterclockwise direction, causing toner within the casing 1041 to circulate counterclockwise therein.

Next will be described the developer cartridge 1050 with reference to FIG. 20A-FIG. 20B.

Figure 20A:
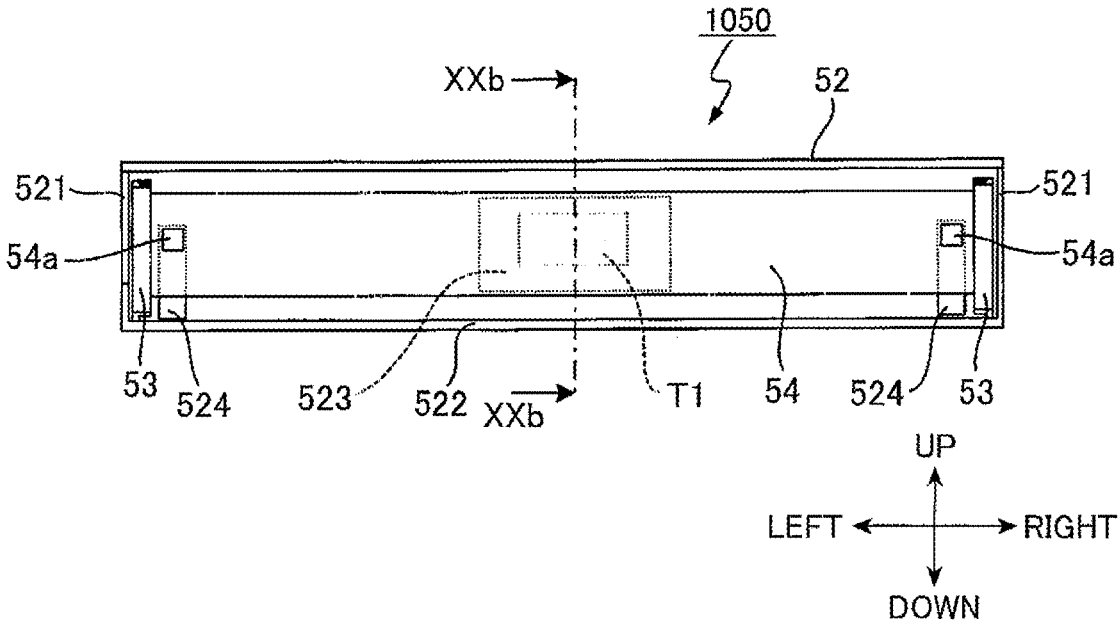
FIG. 20A is a front view of a developer cartridge.
Figure 20B:
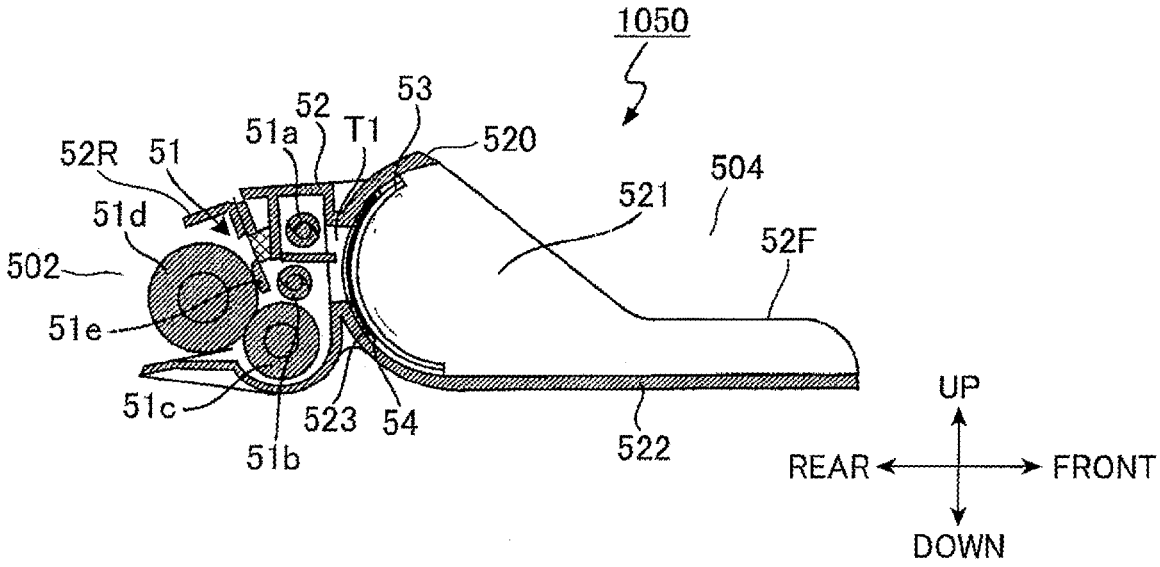
FIG. 20B is a cross-sectional view of the developer cartridge taken along a line XXb-XXb in FIG. 20A.

FIG. 20A and FIG. 20B show the structure of the developer cartridge 1050. FIG. 20A is a front view of the developer cartridge 1050, while FIG. 20B is a cross-sectional view taken through the left-to-right center of the developer cartridge 1050 and viewed from the left side, as indicated by XXb in FIG. 20A.

The developer cartridge 1050 is the same as the developer cartridge 50 of the first embodiment except that the developer cartridge 1050 is formed with no through-holes 521*a* or no disc members 55 and that the opening T1 has the same planar shape and open area as the opening U2 formed in the outer semicylinder 1042. So, parts and components in the developer cartridge 1050 the same as those in the developer cartridge 50 in the first embodiment will be designated with the same reference numerals used in the first embodiment, and a description of these components will not be repeated.

Hence, when mounting the toner cartridge 1040 into the front side of the casing 52, the protrusions 1422 of the toner cartridge 1040 pass through the through-holes 54*a* of the shutter 54 and are inserted into the guide grooves 524. When the outer semicylinder 1042 is subsequently rotated so that the protrusions 1422 face the bottom wall 522, the shutter 54 also moves over the bottom wall 522, thereby opening the opening T1. When detaching the toner cartridge 1040, the outer semicylinder 1042 is rotated so that the protrusions 1422 face to the rear. As the outer semicylinder 1042 is rotated in this way, the shutter 54 moves in association along the front surface of the half-round wall 520 of the front part 52F of the casing 52, thereby closing the opening T1.

FIG. 21A through FIG. 21D are explanatory diagrams illustrating how the components in the toner cartridge 1040 and the developer cartridge 1050 operate when the user mounts the toner cartridge 1040 on the developer cartridge 1050.

Figure 21A:
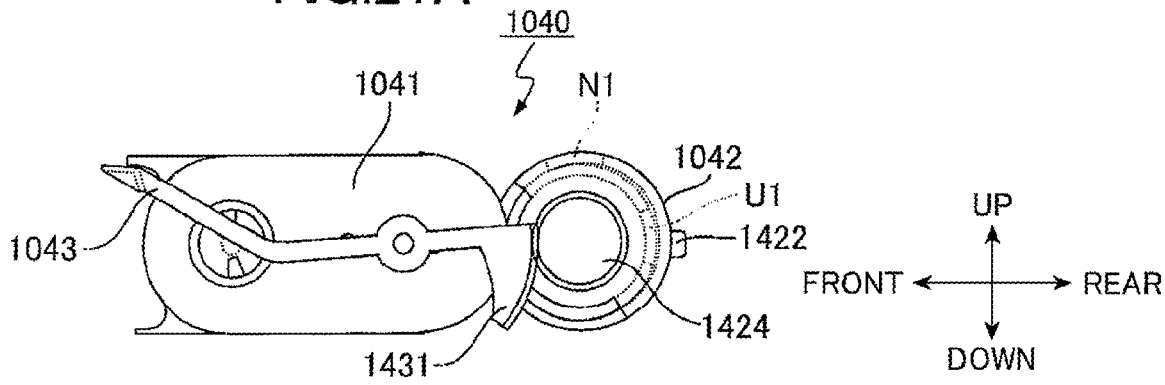

Before the user mounts the toner cartridge 1040 on the developer cartridge 1050, as shown in FIG. 21A, the front ends of the lever members 1043 are raised in the uppermost position so that the orientation of the outer semicylinder 1042 causes the protrusions 1422 face the rear side of the casing 1041. At this orientation, the outer semicylinder 1042 covers the opening U1 formed in the casing 1041.

Figure 21B:
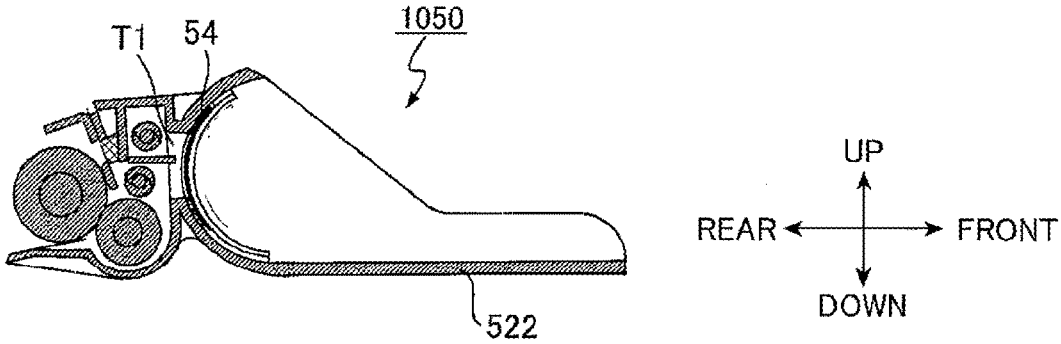

Before the toner cartridge 1040 is mounted on the developer cartridge 1050, as shown in FIG. 21B, the shutter 54 covers the opening T1. The user can subsequently mount the toner cartridge 1040 on the developer cartridge 1050 in a horizontal direction by inserting the rear end of the toner cartridge 1040 into the front surface of the developer cartridge 1050 so that the protrusions 1422 of the toner cartridge 1040 are inserted into the through-holes 54*a* in the shutter 54.

Figure 21C:
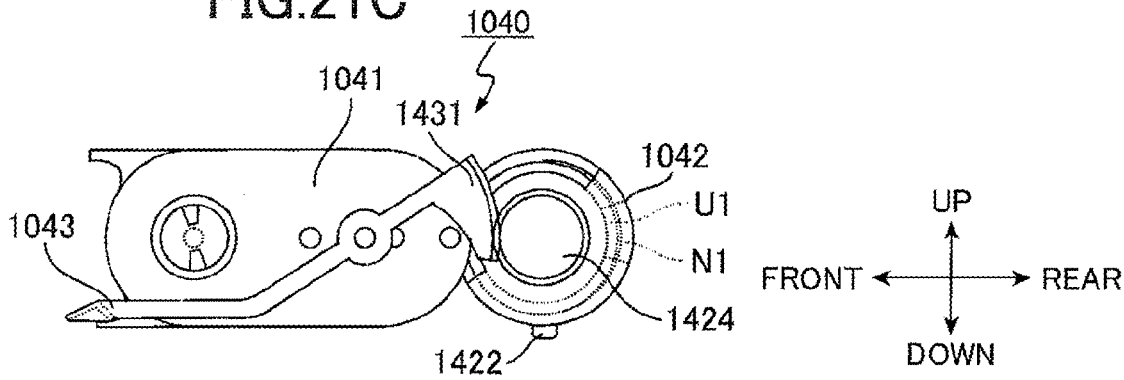
Figure 21D:
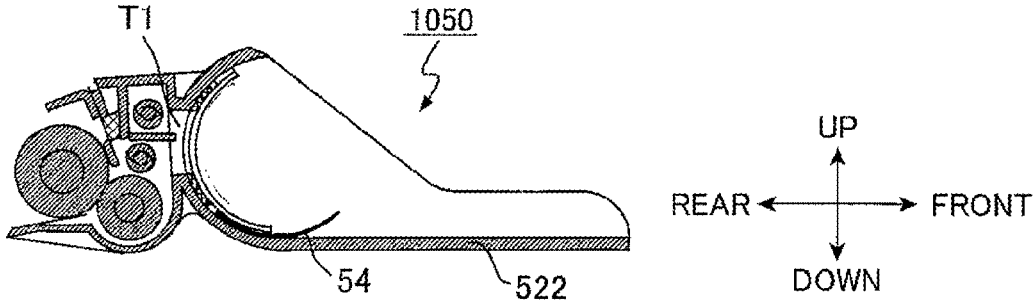

Next, as illustrated in FIG. 21C and FIG. 21D, the user pushes down on the front ends of the lever members 1043, causing the gears 1424 and the outer semicylinder 1042 to rotate together in association until the protrusions 1422 face the bottom wall 522 of the developer cartridge 1050. Consequently, the shutter 54 moves down over the bottom wall 522, opening the opening T1. At this time, the outer semicylinder 1042 rotates until the opening N1 formed in the outer semicylinder 1042 is positioned opposite the opening U1 formed in the casing 1041, thereby opening the opening U1.

Figure 22:
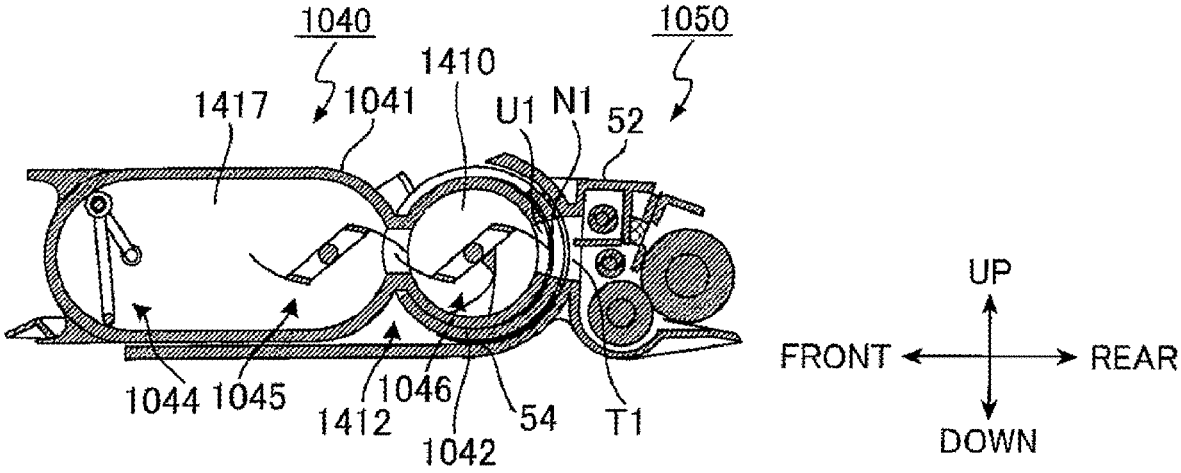
FIG. 22 is a cross-sectional view showing the internal structures of the toner cartridge and the developer cartridge when the toner cartridge is mounted on the developer cartridge and an opening in the toner cartridge and an opening in the developer cartridge are open.

FIG. 22 is a cross-sectional view showing the internal structures of the toner cartridge 1040 and the developer cartridge 1050 when the toner cartridge 1040 is mounted on the developer cartridge 1050 and the opening U1 in the toner cartridge is open. As shown in FIG. 22, the crank mechanism 1044 and agitators 1045 and 1046 in the toner cartridge 1040 generate a motive force for conveying toner within the accommodating section 417 toward the opening U1. Therefore, the toner cartridge 1040 can convey toner in a direction substantially orthogonal to the force of gravity (i.e., a horizontal direction).

In the above description, the casing 1041 is formed with the depressions 1412 and 1411 in the bottom surface and the top surface of the casing 1041. However, the casing 1041 may be formed with one depression in only one of the bottom surface and the top surface of the casing 1041.

While the invention has been described in detail with reference to the above aspects thereof, it would be apparent to those skilled in the art that various changes and modifications may be made therein without departing from the spirit of the invention.

For example, the laser printer 1 may be modified to a photocopier, facsimile device, multifunction device, or any types of image-forming device that forms images on a recording medium by depositing toner on an electrostatic latent image to develop the image and by transferring the developed image onto the recording medium. In the above description, the printer 1 uses a single type of toner to form monochromatic images. However, the printer 1 may be modified to use a plurality of types of toner to form multicolor images.

In the first embodiment, the pair of lever members 43 may not be connected with the connecting member 433.

In the first embodiment, the cylindrical through-hole 411 may be modified to be closed at its pair of opposite ends in the same manner as the cylindrical hole 1411 in the second embodiment. In this case, the inner cylinder 42 is not exposed outside.

In the first embodiment, both of the pair of lever members 43 extend in the front direction, which is opposite to the rear direction, in which the toner cartridge 40 discharges toner to the developing cartridge 50. However, only one of the pair of lever members 43 may extend in the front direction. Similarly, in the second embodiment, only one of the pair of lever members 1043 may extend in the front direction.

What is claimed is:

1. A toner cartridge comprising:

a casing that is configured to accommodate toner therein, the casing being formed with a first casing opening, the casing having one edge and another edge opposite to the one edge along a predetermined direction, the one edge being located at an upstream side relative to the another edge in the predetermined direction, the first casing opening being located at the another edge;

a partitioning wall that is configured to be rotatable relative to the casing around a predetermined rotational axis, the partitioning wall having a side surface that extends substantially parallel to the rotational axis and a pair of opposite ends that are arranged opposing each other along the rotational axis, a first partitioning-wall opening being formed through the side surface of the partitioning wall, the first partitioning-wall opening being selectively aligned with the first casing opening when the partitioning wall is rotated relative to the casing, the first partitioning-wall opening providing communication between the interior and exterior of the casing to discharge toner from the casing when aligned with the first casing opening; and an operation member rotating the partitioning wall relative to the casing, the operation member including a pair of lever members rotatably supported on the casing, the pair of lever members applying a rotating operation to both of the pair of opposite ends of the partitioning wall, wherein the casing includes:

a curved downstream end part that is located at the another edge, the curved downstream end part having therein an inner hollow space substantially of a cylindrical shape, the curved downstream end part having a curved surface that is curved around the rotational axis, the partitioning wall being rotatable relative to the curved downstream end part along the curved surface, the first casing opening being formed in the curved downstream end part in communication with the inner hollow space of the curved downstream end part;

an upstream part that is located in the upstream side of the curved downstream end part in the predetermined direction and that is connected to the curved downstream end part, the upstream part having therein an inner hollow space, the inner hollow space of the upstream part accommodating toner therein; and an intermediate wall located between the curved downstream end part and the upstream part, a second casing opening being formed through the intermediate wall and communicating the inner hollow space of the curved downstream end part with the inner hollow space of the upstream part, the second casing opening being located opposing the first casing opening along the predetermined direction.

2. A toner cartridge according to claim 1, further comprising a connecting member connecting the lever members together.

3. A toner cartridge according to claim 1, wherein the casing is configured to be mounted in a developing device that deposits toner on electrostatic latent images to develop the latent images, and wherein at least one of the lever members extends in a direction opposite a direction in which the toner cartridge discharges toner to the developing device when the casing is mounted in the developing device.

4. A toner cartridge according to claim 3, wherein the at least one of the lever members extends in a direction opposite the predetermined direction with a tip end protruding in an upstream side of the one edge of the casing.

5. A toner cartridge according to claim 1, wherein the partitioning wall is configured substantially of a cylindrical shape and is mounted inside the casing.

6. A toner cartridge according to claim 1, wherein the partitioning wall is configured substantially of a semicylindrical shape and is mounted outside the casing.

7. A developing device for use with a toner cartridge according to claim 1 for developing electrostatic latent images by depositing toner discharged from the toner cartridge onto the latent images, the developing device comprising:

a developing-device wall that is configured to receive the toner cartridge thereon, the developing-device wall being formed with a developing-device-side opening that is disposed opposite the first casing opening in the toner cartridge to receive toner discharged from the first casing opening through the first partitioning-wall opening when the developing-device wall receives the toner cartridge thereon;

a shutter that is configured to open and close the developing-device-side opening;

a holding mechanism that holds the shutter so that the shutter is configured to move between a position exposing the developing-device-side opening and a position closing the developing-device-side opening; and a transmission mechanism that engages with the lever members of the toner cartridge to move the shutter as the lever members rotate and that transmits the rotation of the lever members to the both ends of the partitioning wall in the toner cartridge.

8. A combination of a toner cartridge and a developing device, the combination comprising:

a toner cartridge comprising:

a casing that is configured to accommodate toner therein, the casing being formed with a first casing opening, the casing having one edge and another edge opposite to the one edge along a predetermined direction, the one edge being located at an upstream side relative to the another edge in the predetermined direction, the first casing opening being located at the another edge;

a partitioning wall that is configured to be rotatable relative to the casing around a predetermined rotational axis, the partitioning wall having a side surface that extends substantially parallel to the rotational axis and a pair of opposite ends that are arranged opposing each other along the rotational axis, a first partitioning-wall opening being formed through the side surface of the partitioning wall, the first partitioning-wall opening being selectively aligned with the first casing opening when the partitioning wall is rotated relative to the casing, the first partitioning-wall opening providing communication between the interior and exterior of the casing to discharge toner from the casing when aligned with the first casing opening; and an operation member rotating the partitioning wall relative to the casing, the operation member including a pair of lever members rotatably supported on the casing that when rotated apply a rotating operation to both of the pair of opposite ends of the partitioning wall, wherein the casing includes:

a curved downstream end part that is located at the another edge, the curved downstream end part having therein an inner hollow space substantially of a cylindrical shape, the curved downstream end part having a curved surface that is curved around the rotational axis, the partitioning wall being rotatable relative to the curved downstream end part along the curved surface, the first casing opening being formed in the curved downstream end part in communication with the inner hollow space of the curved downstream end part;

an upstream part that is located in the upstream side of the curved downstream end part in the predetermined direction and that is connected to the curved downstream end part, the upstream part having therein an inner hollow space, the inner hollow space of the upstream part accommodating toner therein; and an intermediate wall located between the curved downstream end part and the upstream part, a second casing opening being formed through the intermediate wall and communicating the inner hollow space of the curved downstream end part with the inner hollow space of the upstream part, the second casing opening being located opposing the first casing opening along the predetermined direction; and a developing device that develops electrostatic latent images by depositing toner discharged from the toner cartridge onto the latent images, the developing device comprising:

a developing device wall that is configured to receive the toner cartridge thereon, the developing-device wall being formed with a developing-device-side opening that is disposed opposite the first casing opening in the toner cartridge to receive toner discharged from the first casing opening through the first partitioning-wall opening when the developing-device wall receives the toner cartridge thereon;

a shutter that is configured to open and close the developing-device-side opening;

a holding mechanism that holds the shutter so that the shutter is configured to move between a position exposing the developing-device-side opening and a position closing the developing-device-side opening; and a transmission mechanism that engages with the lever members of the toner cartridge to move the shutter as the lever members rotate and that transmits the rotation of the lever members to the both ends of the partitioning wall in the toner cartridge.

* * * * *